US006680704B2

(12) United States Patent
Cassel et al.

(10) Patent No.: US 6,680,704 B2
(45) Date of Patent: Jan. 20, 2004

(54) BUILT-IN PATCH ANTENNA

(75) Inventors: Jan Cassel, Djursholm (SE); Erland Cassel, Djursholm (SE)

(73) Assignee: Telefonaktiebolaget LM Ericsson(publ), Stockholm (SE)

( * ) Notice: Subject to any disclaimer, the term of this patent is extended or adjusted under 35 U.S.C. 154(b) by 0 days.

(21) Appl. No.: 10/121,158

(22) Filed: Apr. 11, 2002

(65) Prior Publication Data

US 2002/0175865 A1 Nov. 28, 2002

Related U.S. Application Data

(60) Provisional application No. 60/288,274, filed on May 3, 2001.

(51) Int. Cl.[7] ..... H01Q 1/32; H01Q 1/38

(52) U.S. Cl. ..... 343/700 MS; 343/846

(58) Field of Search ..... 343/700 MS, 846, 343/713, 848, 767, 702

(56) References Cited

U.S. PATENT DOCUMENTS

| | | | | |
|---|---|---|---|---|
| 5,986,606 A | * | 11/1999 | Kossiavas et al. | 343/700 MS |
| 6,147,649 A | | 11/2000 | Ivrissimtzis et al. | 343/700 |
| 6,222,497 B1 | * | 4/2001 | Hu et al. | 343/846 |
| 6,424,309 B1 | * | 7/2002 | Johnston et al. | 343/767 |

FOREIGN PATENT DOCUMENTS

| | | |
|---|---|---|
| EP | 0 777 295 | 6/1997 |
| WO | WO 01/57952 | 8/2001 |
| WO | WO 02/05384 | 1/2002 |

OTHER PUBLICATIONS

Kossiavas, G.; Papiernik, A.; Brachat, P. and Ratajczak, P.; "*A Quarter–Wavelength Antenna with Superposed Square Patches*"; Microwave Journal; Jun. 1998; pp. 82, 84, 86, and 89;.

ISR; PCT/EP 02/04720; Date Mailed Sep. 16, 2002.

* cited by examiner

*Primary Examiner*—James Clinger
(74) *Attorney, Agent, or Firm*—Jenkens & Gilchrist, P.C.

(57) ABSTRACT

An antenna apparatus has a patch radiator member; a ground-plane back-up element for the patch radiator member; and a feed arrangement connecting the patch radiator member to radio circuitry. The patch radiator member has inner and outer patch portions that define a first open slot between first edges of the patch portions. A metallic wall portion connects second edges of the patch portions that are opposed to the first edges, and reflects a wave propagating toward the metallic wall portion and feeds the reflected wave toward the first open slot with a 180 degree phase reversal. A reflector-and-slot extension-metallic arm is folded over another open slot between the first edge of the inner patch portion and the ground plane back-up element to provide a 180 degree phase reversal by reflect-feedback of an outgoing wave from the another slot. The antenna apparatus can be made in small size for mounting within portable communications devices, while maintaining satisfactory operating characteristics.

30 Claims, 46 Drawing Sheets

[880 MHz-H-plan]

[880 MHz-E-plan]

[960 MHz-H-plan]

[960 MHz-E-plan]

[1575 MHz-H-plan]

[1575 MHz-E-plan]

[1710 MHz-H-plan]

[1710 MHz-E-plan]

[1890 MHz-H-plan]

[1890 MHz-E-plan]

[2110 MHz-H-plan]

[2110 MHz-E-plan]

[2500 MHz-H-plan]

[2500 MHz-E-plan]

[880 MHz-H-plan]

[880 MHz-E-plan]

[960 MHz-H-plan]

[960 MHz-E-plan]

[1710 MHz-H-plan]

[1710 MHz-E-plan]

[1890 MHz-H-plan]

[1890 MHz-E-plan]

[2110 MHz-H-plan]

[2110 MHz-E-plan]

[2500 MHz-H-plan]

[2500 MHz-E-plan]

[880 MHz-H-plan]

[880 MHz-E-plan]

[960 MHz-H-plan]

[960 MHz-E-plan]

[1575 MHz-H-plan]

[1575 MHz-E-plan]

[1710 MHz-H-plan]

[1710 MHz-E-plan]

[1890 MHz-H-plan]

[1890 MHz-E-plan]

[2110 MHz-H-plan]

[2110 MHz-E-plan]

[880 MHz-H-plan]

[880 MHz-E-plan]

[960 MHz-H-plan]

[960 MHz-E-plan]

[1710 MHz-H-plan]

[1710 MHz-E-plan]

[2110 MHz-H-plan]

[2110 MHz-E-plan]

[830 MHz-H-plan]

[830 MHz-E-plan]

[2170 MHz-H-plan]

[2170 MHz-E-plan]

[830 MHz-H-plan]

[830 MHz-E-plan]

[960 MHz-H-plan]

[960 MHz-E-plan]

[1710 MHz-H-plan]

[1710 MHz-E-plan]

[2170 MHz-H-plan]

[2170 MHz-E-plan]

BUILT-IN PATCH ANTENNA

This application claims the benefit of copending U.S. Provisional Patent Application Serial No. 60/288,274 filed May 3, 2001.

BACKGROUND OF THE INVENTION

1. Field of the Invention

The present invention relates generally to the telecommunications field; and, more particularly, to miniature antenna apparatus for portable communications devices.

2. Description of the Prior Art

The use of portable communications devices, such as mobile telephones, has grown rapidly in recent years. Due to their increased usage and demand, mobile phones and the like have become smaller, lighter in weight and provide numerous features. Consumers, however, continue to demand even smaller and lighter devices that, at the same time, offer even more features.

An important component of mobile phones and other portable communications devices is the antenna used by the devices. In the case of small, lightweight devices, in particular, antennas are required that are also small in size. In addition, antennas that do not extend from the device, and, in fact, that are not even external to the device, are often considered highly desirable and are frequently touted in advertising campaigns in an effort to provide a manufacturer with a competitive edge in the marketplace.

Portable communications devices, such as mobile phones, that are currently in the marketplace utilize several different types of antennas. Among such antenna types include telescopic antennas, stub antennas and patch antennas. Telescopic and stub antennas are both external to the communications device and project outwardly from the chassis of the device. Patch antennas, on the other hand, may be incorporated within the chassis of the communications device; and for some users, communications devices with patch antennas are preferred over devices that include outwardly projecting antennas.

Portable communications devices operate in one or more of a plurality of frequency bands. Such bands include, for example, the 900 MHz, 1800 MHz and 1900 MHz bands (GSM and PCS bands). Accordingly, antennas designed for use in these devices must be able to operate in one or more of these frequency bands.

As the size of mobile phones and other portable communications devices is reduced, patch antennas for such devices must also be reduced in size in order to properly fit within the smaller devices. A reduction in the size of a patch antenna, however, often leads to certain undesirable characteristics with respect to the desired operating frequencies of the antenna. These undesirable characteristics may include, for example, a loss of efficiency, a reduction in bandwidth and a reduction in antenna gain.

There is, accordingly, a significant need for a patch antenna apparatus that is reduced in size so that it may be incorporated into the smaller mobile phones and other portable communications devices that are being developed; and, at the same time, that is capable of operating in a plurality of desired frequency bands while providing satisfactory performance in terms of efficiency, bandwidth and gain.

SUMMARY OF THE INVENTION

The present invention provides a patch antenna apparatus that is of small size so as to be able to fit within the chassis of a mobile phone or other portable communications devices, and that provides satisfactory performance characteristics when operating in desired frequency bands.

More particularly, one aspect of the present invention comprises an antenna apparatus for a portable communications device. The antenna apparatus comprises a patch radiator member, a ground-plane back-up element for the patch radiator member, and a feed arrangement connecting the patch radiator member to radio circuitry in the portable communications device. The patch radiator member includes an inner patch portion and an outer patch portion that are spaced from and substantially parallel to one another and that define a first open slot between first edges of the inner and outer patch portions. The patch radiator member also includes a metallic wall portion connecting second edges of the inner and outer patch portions that are opposed to the first edges. The metallic wall portion reflects a wave propagating toward the metallic wall portion and feeds the reflected wave toward the first open slot with a 180 degree phase reversal.

By providing the patch antenna apparatus according to the present invention, the apparatus can be significantly reduced in size; and, at the same time, provide satisfactory performance characteristics for use in a mobile phone or in other portable communications devices.

According to one embodiment of the invention, the inner patch portion is of an hourglass shape, and the outer patch portion is of rectangular shape. The hourglass shape of the inner patch portion makes it easier to transfer wave energy from a space between the inner patch portion of the patch radiator member and the ground-plane back-up element to the space between the inner and outer patch portions.

According to another embodiment of the invention, the ground-plane back-up element comprises a copper plate, and a copper strip connects a corner of the outer patch portion to the back side of the copper plate to lower the primary resonance frequency of the antenna apparatus.

According to a further embodiment of the invention, the antenna apparatus also includes a second open slot between the ground-plane back-up element and the second edge of the inner patch portion, and a third open slot between the ground-plane back-up element and the first edge of the inner patch portion. A wave emanating from the third open slot must also be phase-shifted by 180 degrees, and this is accomplished by including a reflector-and-slot extension metallic arm that extends from an end of the metallic wall portion parallel to one of the side edges of the patch portions, over the first edge of the inner patch portion and over the third open slot to provide the 180 degree phase shift by reflect-feedback of the outgoing wave from the third open slot.

According to yet further embodiments of the invention, an apparatus is provided that comprises a single patch portion and a reflector-and-slot extension metallic arm. The single patch portion can, for example, be of hourglass shape or of rectangular shape.

In general, the present invention provides a patch antenna apparatus that may be incorporated within the chassis of a mobile phone or other portable communications device. The antenna apparatus can be of small size, for example, 40 mm in width, 10 mm in depth and have a height of at least as small as about 19 mm, and still provide satisfactory operating characteristics at frequency bands of interest. The antenna apparatus can also be operated in either a broadband mode or a multiband mode by proper selection of the feedpoint of the feed arrangement and the ground point.

BRIEF DESCRIPTION OF THE DRAWINGS

Further objects, features and advantages of the present invention will become apparent hereinafter in conjunction with the following detailed description of presently preferred embodiments thereof.

DETAILED DESCRIPTION OF PRESENTLY PREFERRED EMBODIMENTS OF THE INVENTION

A known patch antenna of the halfwave type ($\lambda/2\times\lambda/2$), operating in the 900 MHz frequency band, has a size of 166 mm×166 mm. An initial objective in the development of the present invention was to provide a patch antenna apparatus capable of being mounted inside the chassis of a mobile telephone adjacent the back side of the phone, and having the following dimensions:

Width: 40 mm

Height: 25 mm

Depth: 8–10 mm.

A further objective was that the antenna apparatus provide maximum radiation outwardly from the back side of the mobile phone, and that it operate in the frequency bands of 880 MHz –960 MHz and 1710 MHz –2110 MHz with radiation characteristics at least equal to a Jane-antenna (a top-loaded helical stub-antenna designed for single frequency bands).

It is a known rule in antenna design that the size of an antenna should not be less than about 1/10th of the wavelength at the desired frequency band in order to maintain high efficiency and a reasonable bandwidth. At 900 MHz, $\lambda$ is 333 mm. Accordingly, based on the above rule, the patch antenna should have a height of about 32 mm for satisfactory operation at 900 MHz. This height is larger than the desired height of 25 mm, however, measured values obtained utilizing such a design are helpful as a reference to determine antenna gain and bandwidth for antennas having a lesser height.

A rectangular patch can be viewed as a broad microstrip transmission line which is fed close to the middle of one of the parallel sides, whereupon a wave will spread along the line to the opposite parallel side. The E-vectors along the slot of the fed side will only work together in the normal direction out from the patch surface with the E-vector along the slot of the opposite side of the patch if the phase of the transmission wave has turned by 180 degrees. This means that the electrical line length between the slots corresponds to a halfwave. The current in the microstrip mainly follows the edges of the patch. By giving the patch a form that resembles an hourglass, the path of the current can be made longer in the otherwise too short patch transmission line.

Figure 1A:
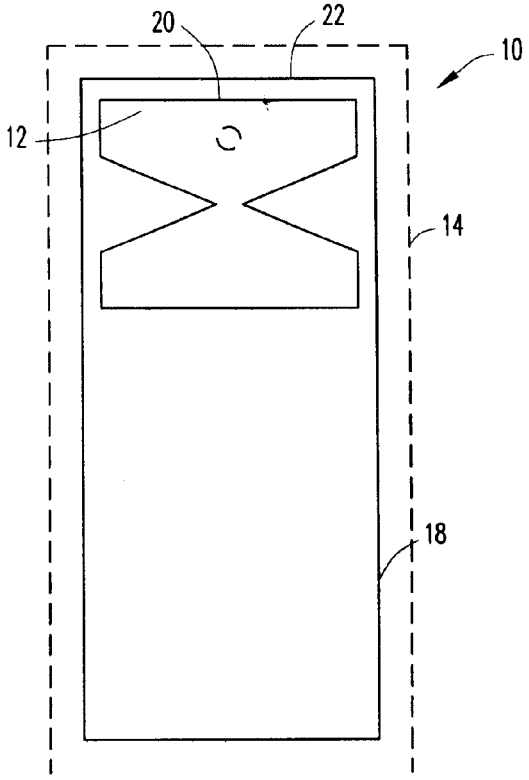
FIGS. 1A and 1B are schematic front and side views, respectively, of a patch antenna apparatus to assist in explaining the present invention.
Figure 1B:
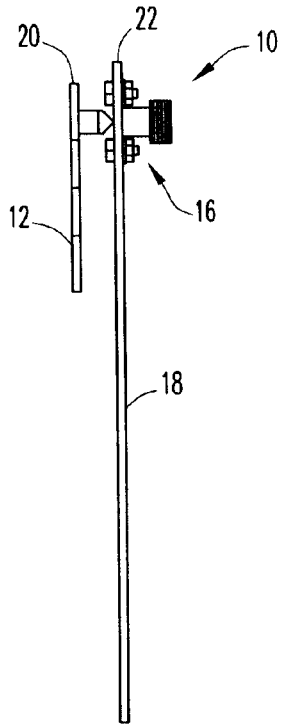

FIGS. 1A and 1B schematically illustrate front and side views, respectively, of a patch antenna apparatus constructed generally as described above in order to assist in explaining the present invention. The patch antenna apparatus is generally designated by reference number 10, and includes a patch antenna 12 of generally hourglass shape. Patch antenna apparatus 10 is adapted to be mounted inside the chassis of a mobile telephone or another portable communications device adjacent the backside thereof. A portion of a mobile telephone is illustrated by dashed line 14 in FIG. 1A. The patch antenna 12 is connected to radio circuitry (not shown) in the mobile phone, in this special case, by an SMA chassis connector 16 or another suitable feed arrangement, and is mounted to be parallel to a copper plate 18 that functions as a ground-plane back-up element, a substitute for a telephone radio printed circuit card. The copper plate 18 in the apparatus of FIGS. 1A and 1B has dimensions of 105 mm high by 45 mm wide by 0.5 mm thick. The patch antenna 12 has dimensions of 40 mm wide by 32 mm high. The patch antenna 12 is mounted to the copper plate 18 such that the upper edge 20 of the antenna is 8 mm below the upper short edge 22 of the copper plate, and is spaced from the copper plate by a distance of about 7 mm.

Figure 2A:
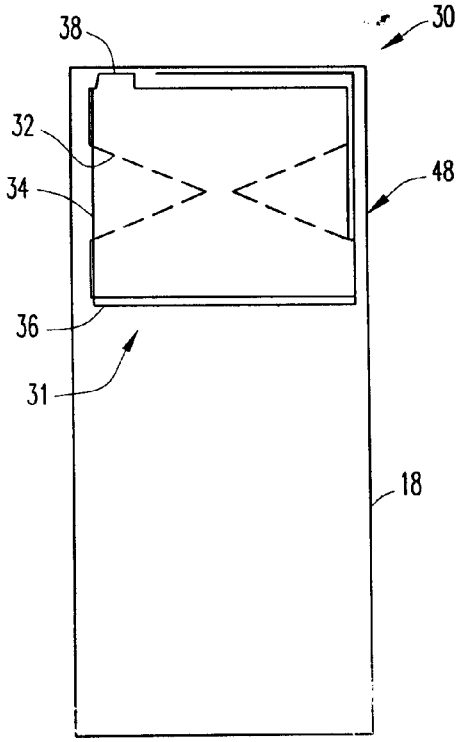
FIGS. 2A and 2B are schematic front and side views, respectively, of a patch antenna apparatus according to a presently preferred embodiment of the present invention.
Figure 2B:
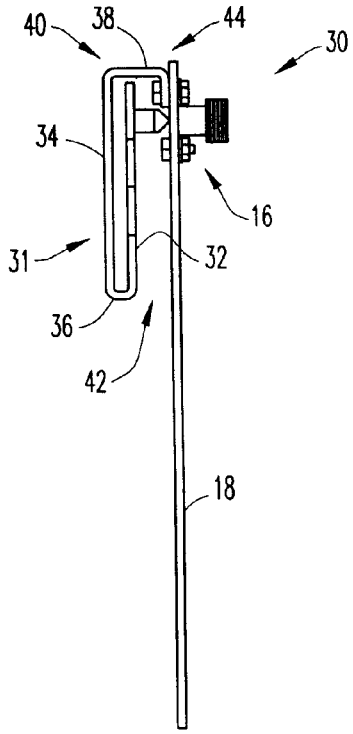
Figure 3:
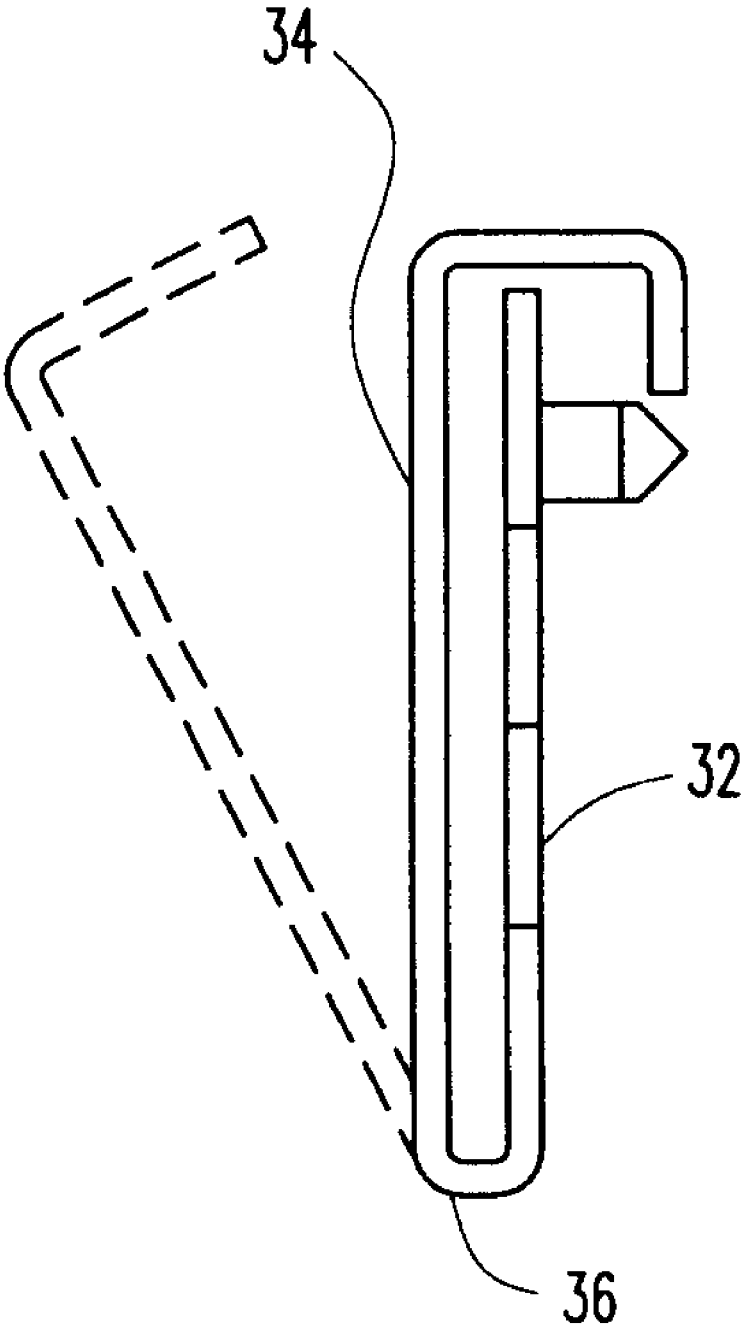
FIG. 3 schematically illustrates a manner in which the patch antenna apparatus of FIGS. 2A and 2B may be constructed according to a further embodiment of the present invention.

FIGS. 2A and 2B schematically illustrate front and side views, respectively, of a patch antenna apparatus 30 according to a presently preferred embodiment of the present invention. FIG. 2A, in particular, is a view of the apparatus looking toward the back side of the mobile phone in which the apparatus is mounted. Antenna apparatus 30 includes a patch antenna 31 comprising an inner hourglass-shaped patch portion 32, that generally corresponds to the patch antenna 12 in FIGS. 1A and 1B, and an outer rectangular-shaped patch portion 34. The inner and outer patch portions 32 and 34 are connected to one another at their lower edges by a metallic wall portion 36. As illustrated in FIG. 3, patch antenna apparatus 30 may be conveniently formed by, in effect, extending the lower portion of the hourglass-shaped patch antenna 12 in FIGS. 1A and 1B downwardly, and then folding the downwardly extending portion outwardly and upwardly over the hourglass-shaped portion.

The metallic wall portion 36 is perpendicular to the inner patch portion 32 and extends outwardly from the lower edge thereof by a distance of 3 mm. The outer patch portion 34 is perpendicular to the metallic wall portion 36 and extends upwardly therefrom so that it is parallel to and outside of the inner hourglass-shaped patch portion. The outer patch portion extends upwardly by a distance such that its upper edge is at the level of the upper edge of the inner patch portion.

In order to lower the primary resonance frequency of the patch antenna apparatus 30, the rectangular-shaped outer patch portion 34 is grounded by a 6 mm wide copper strip 38 that extends from the upper left corner of the outer patch portion, 1 mm above the upper edge of the inner patch portion 32, to the back side of the copper plate 18. The copper strip 38 is, preferably, galvanically connected to the back side of the copper plate 18.

In patch antenna apparatus 30, strong edge currents in the inner probe-fed patch portion 32 and the wave between the inner patch portion and the copper plate 18 excite a wave in the space between the inner and outer patch portions 32 and 34. The energy transfer to between the two patch portions is made easier due to the hourglass-shaped outlet of the inner patch portion. The wave between the two patch portions is reflected against the metallic wall portion 36, and rushes back upwardly toward the open slot 40 defined between the upper edges of the two patch portions to create a "feedback" wave. The reflection against the perfectly conducting lower metallic wall portion 36 results in a 180 degree phase shift which is desirable while focusing on the cooperation between the E-vectors in the upper, open slot 40 between the two patch portions and a lower, open slot 42 between the lower edge of the inner patch portion and the copper plate, for maximum radiation outwardly in the direction perpendicular to the patch portions and the back side of the mobile telephone.

In addition to the above-mentioned open slots 40 and 42, the patch antenna apparatus 30 also includes a third slot 44 between the copper plate 18 and the upper edge of the inner patch portion 32 just above the feed point. The wave emanating from this slot must cooperate with the radiation emanating from the upper slot 40; and, accordingly, the wave from the third slot 44 must also be phase shifted by 180 degrees. This is preferably accomplished by providing a reflector-and-slot-extension metallic arm 48 which extends from the right end of the metallic wall portion 36 upwardly along and parallel to the right short edges of the inner and outer patch portions at a distance of about 1 mm from the right short edges in a plane orthogonal to the plane of the patch portions. The arm 48 then turns to extend over the top edge of the inner patch portion, without touching the patch portions, and over the third open slot 44 in order to provide the 180 degree phase shift by reflect-feedback of the outgoing wave from the third slot.

Figure 4:
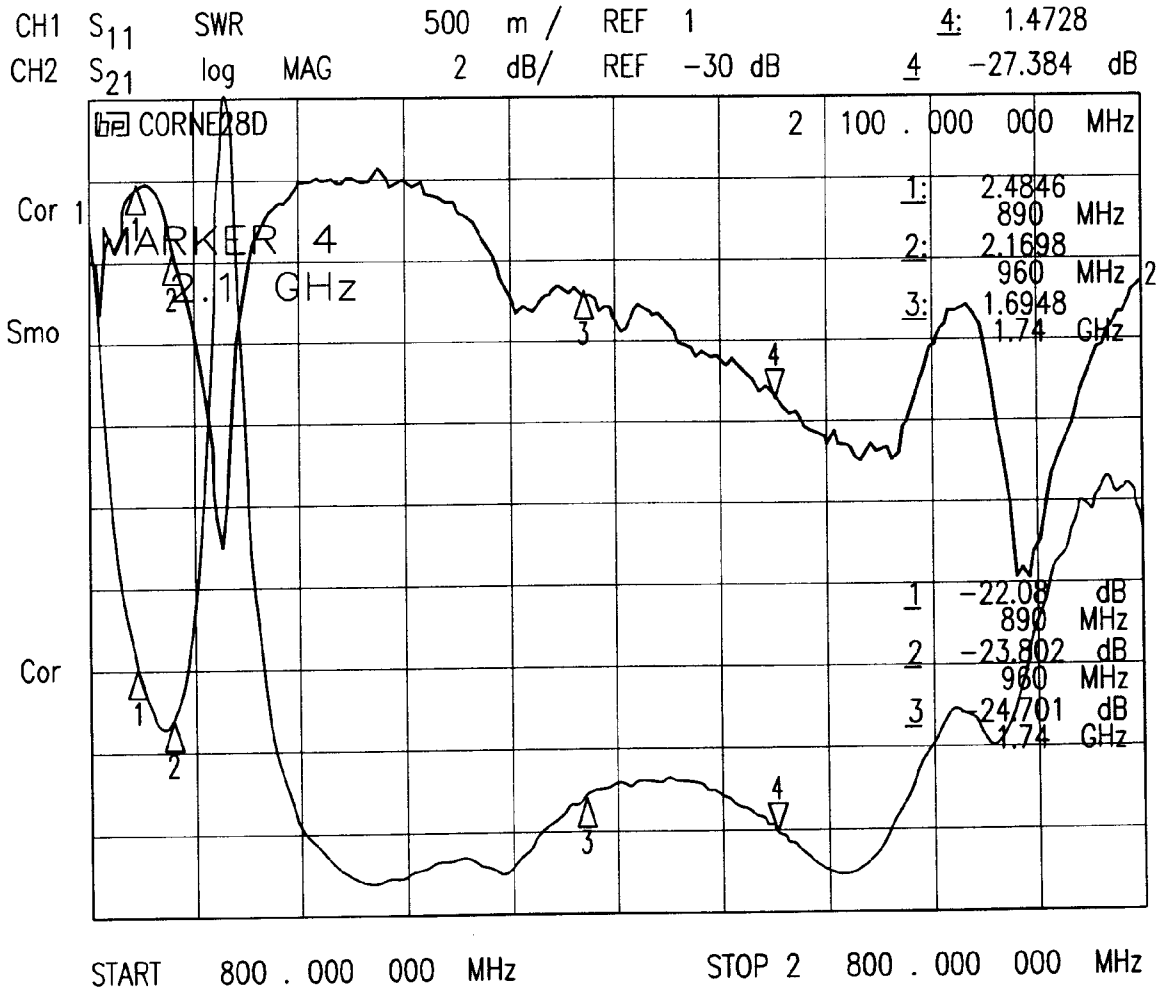
FIG. 4 is a diagram that illustrates an example of a VSWR curve and a radiation curve for a "Broadband Feedback Patch Antenna" apparatus according to an embodiment of the present invention.
Figure 5:
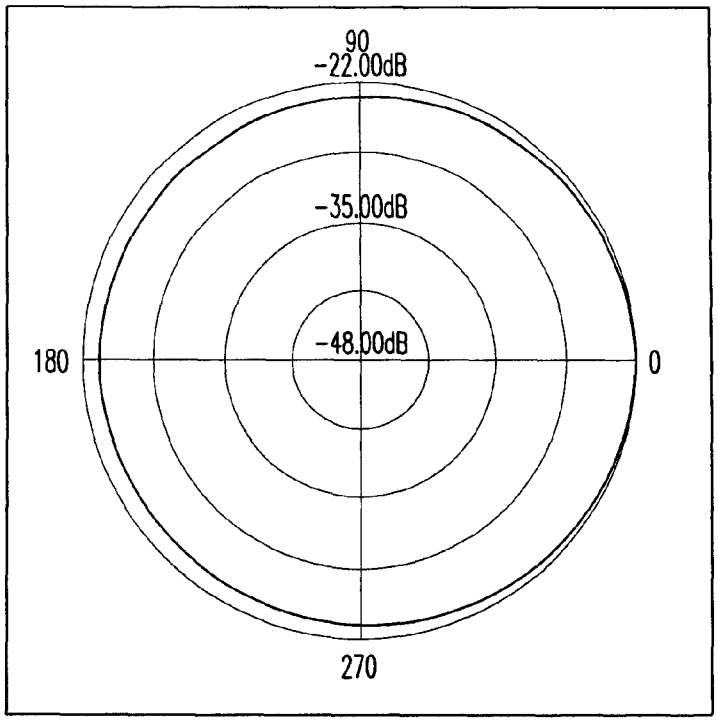
FIGS. 5–18 are measured radiation diagrams for the Broadband Feedback Patch Antenna apparatus described with reference to FIG. 4.
Figure 6:
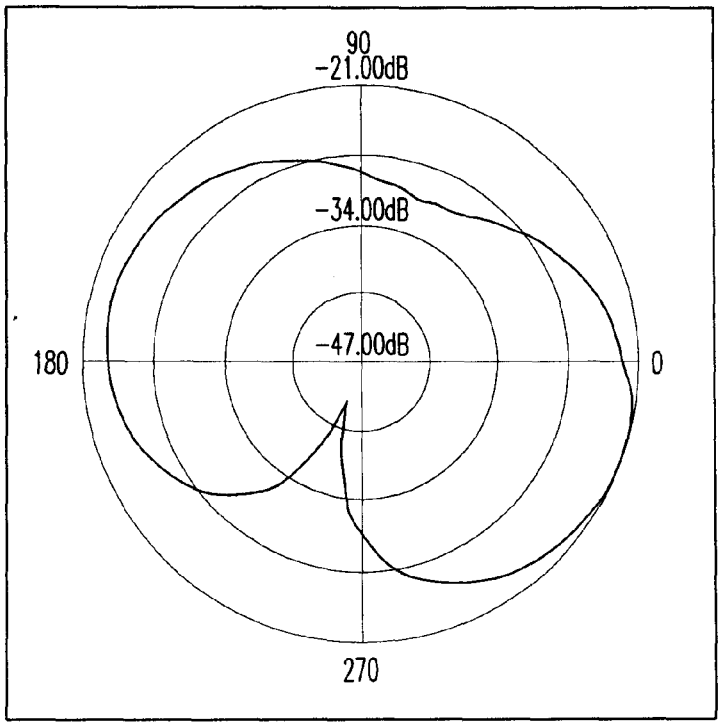
Figure 7:
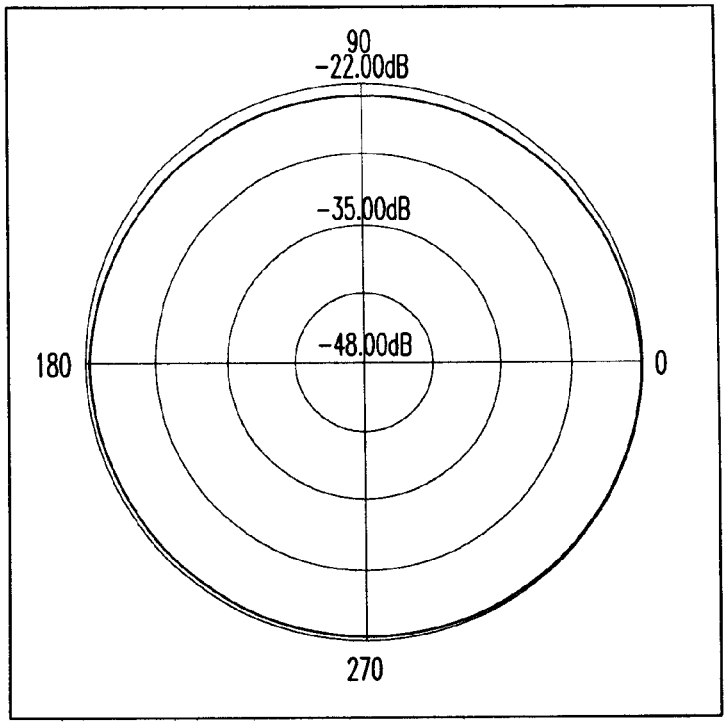
Figure 8:
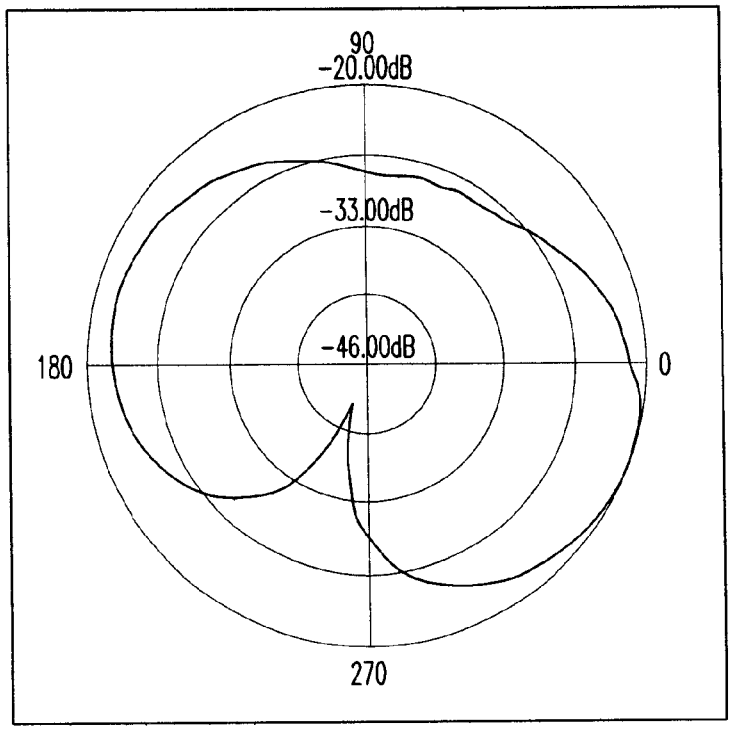
Figure 9:
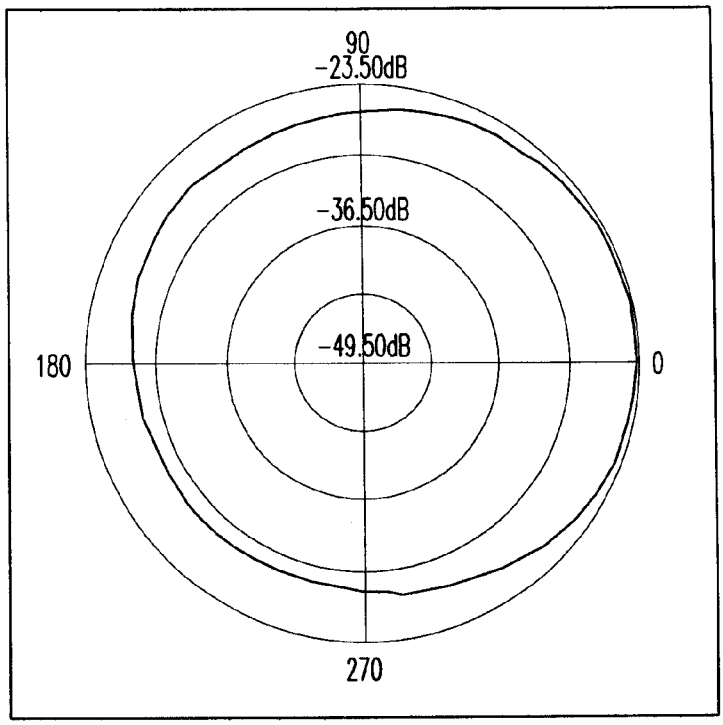
Figure 10:
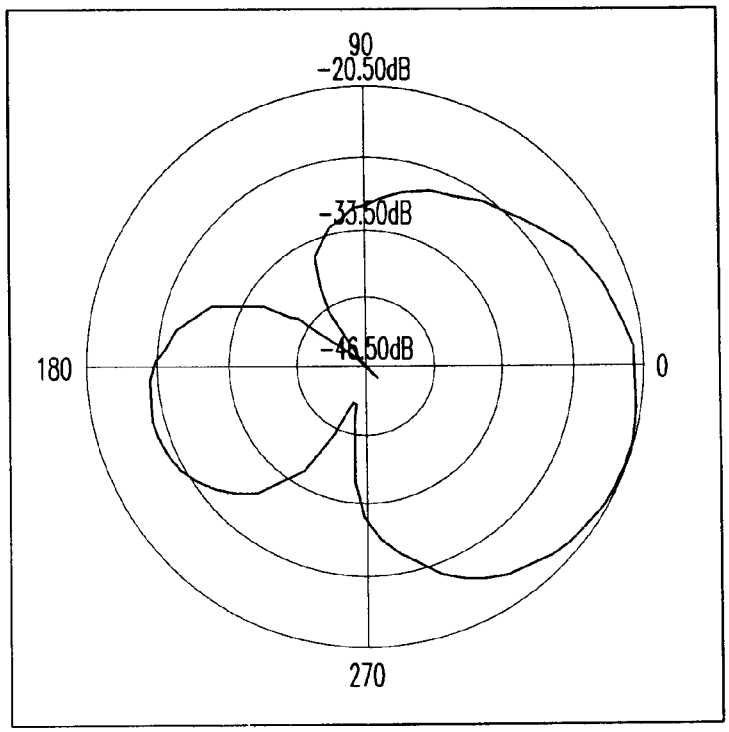
Figure 11:
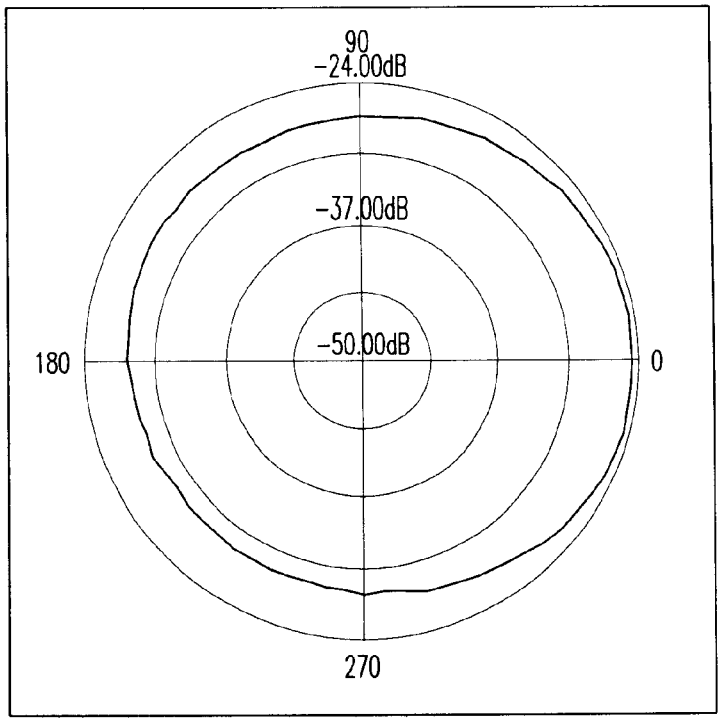
Figure 12:
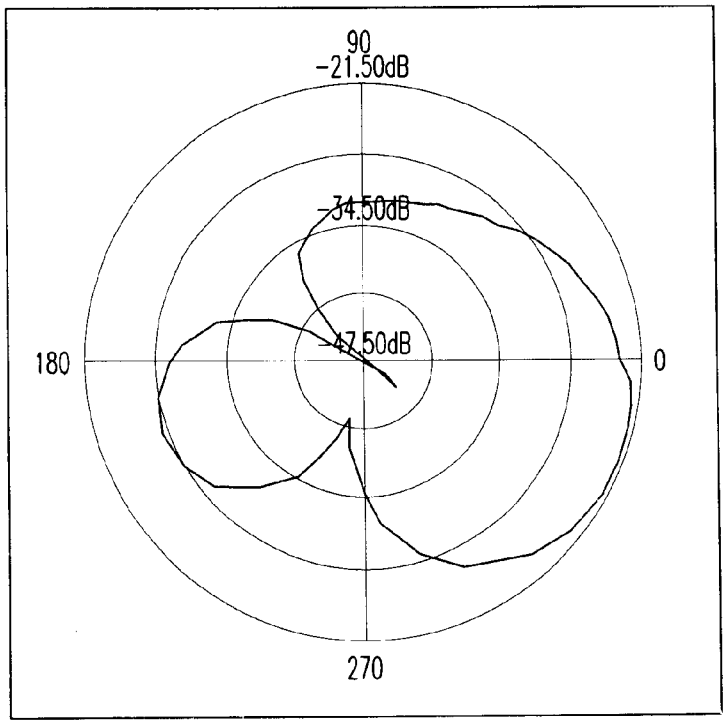
Figure 13:
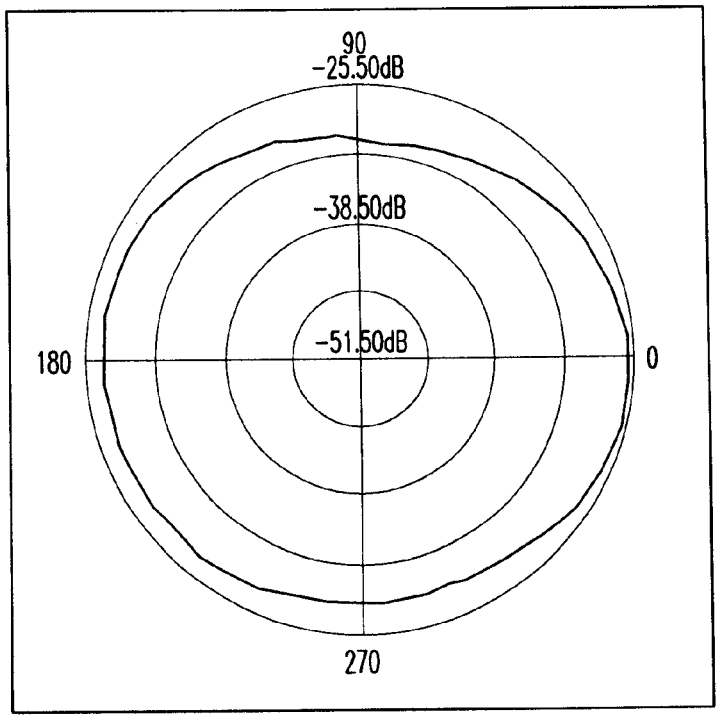
Figure 14:
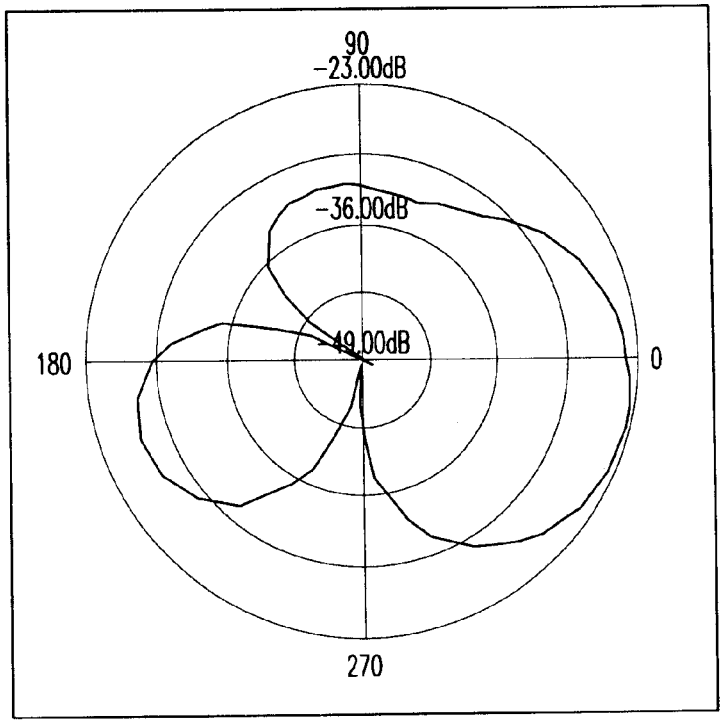
Figure 15:
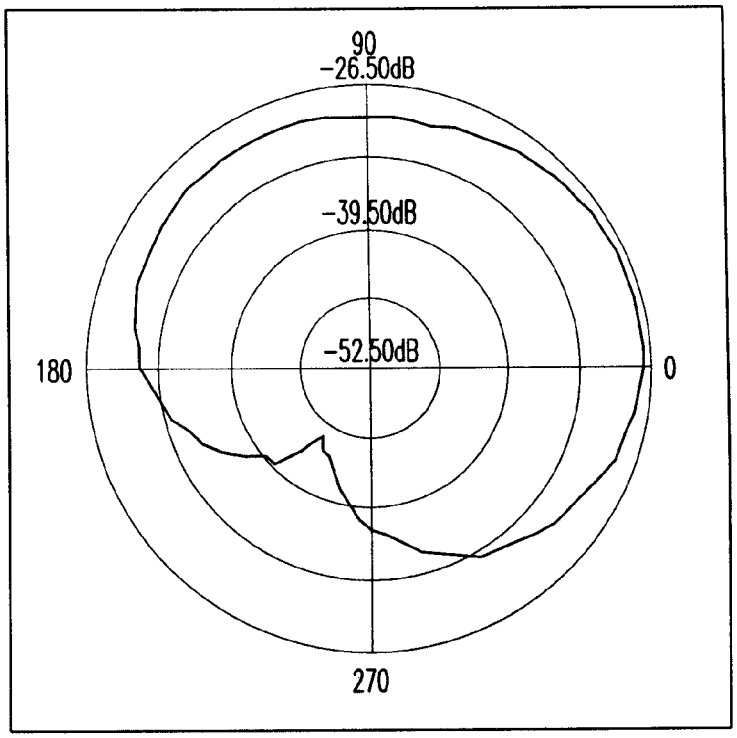
Figure 16:
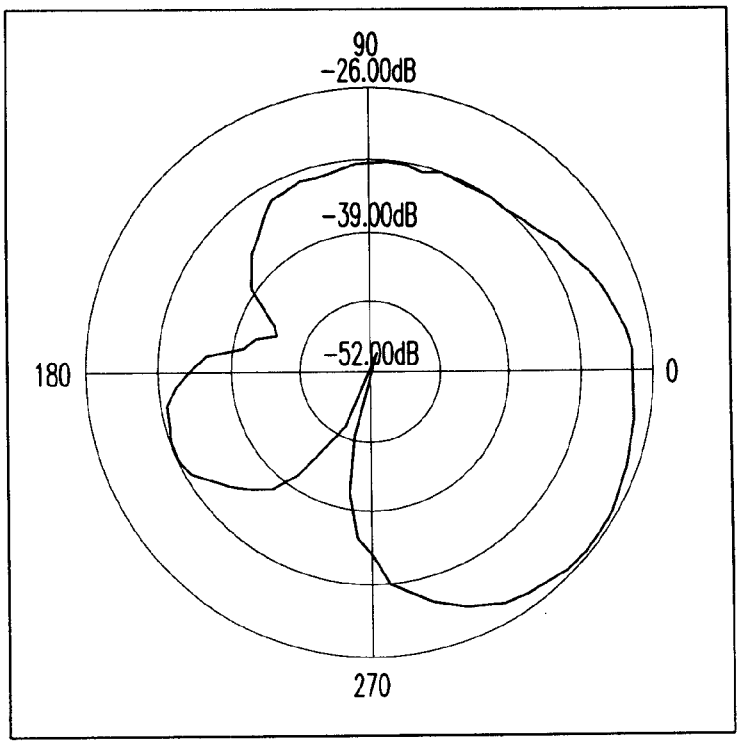
Figure 17:
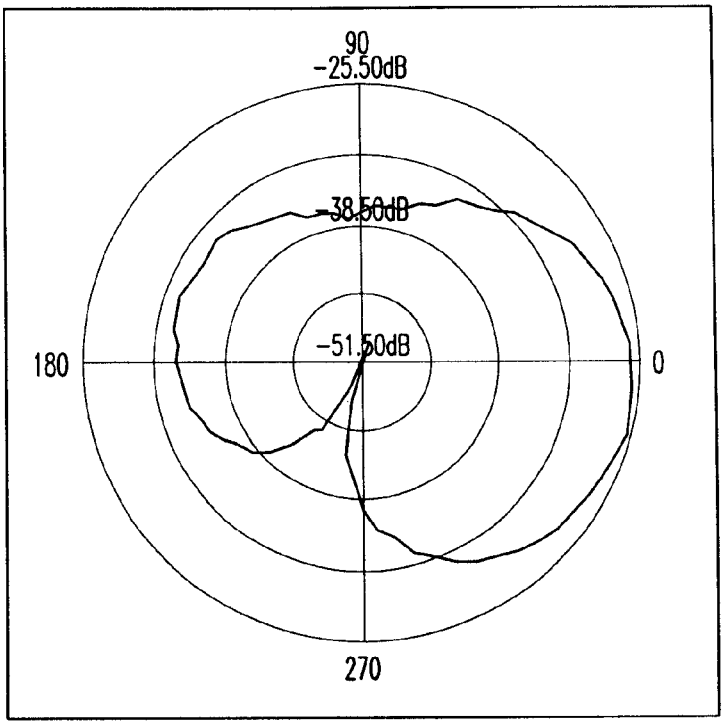
Figure 18:
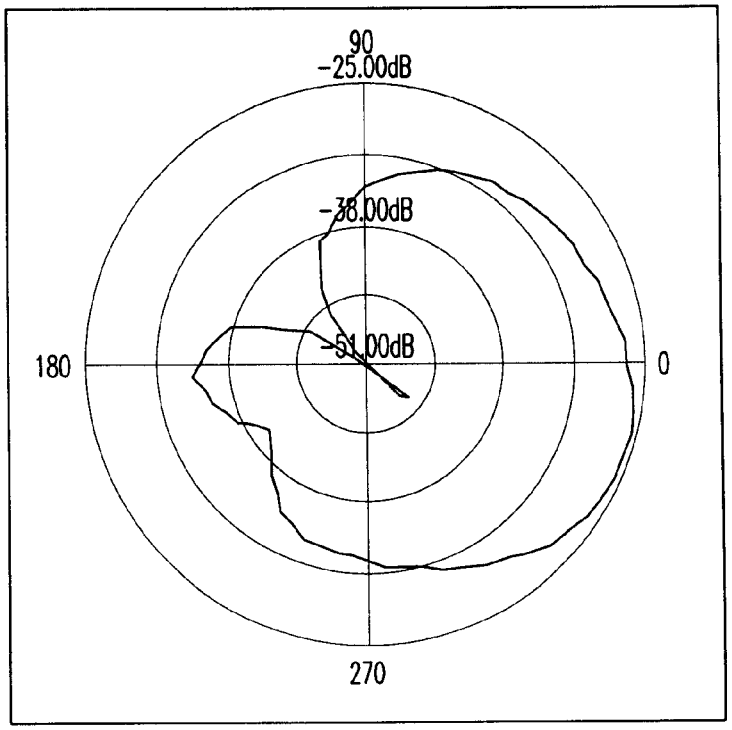

By proper choice of the probe feedpoint and the ground point for the "Feedback Patch Antenna" illustrated in FIGS. 2A and 2B, frequency characteristics of either "Broadband" type or "Multiband" type can be achieved. FIG. 4 is an $S_{11}/S_{12}$ diagram illustrating an example of a VSWR curve (solid line) and a radiation curve (dashed line) measured in the direction perpendicularly outward from the back side of the mobile telephone in which the antenna apparatus is mounted for a "Broadband Feedback Patch Antenna" according to an embodiment of the present invention (wherein the patch antenna 31 has a height of 32 mm). It should be noted from FIG. 4, that the antenna, at 1800 MHz has the same measured antenna gain in the direction perpendicular to the back side of the mobile phone as a free, full-sized (i.e., about 80 mm) resonance halfwave antenna.

FIGS. 5–18 are measured radiation diagrams for the Broadband Feedback Patch Antenna described above with reference to FIG. 4. The antenna's H-plane at different frequency bands is shown in FIGS. 5, 7, 9, 11, 13, 15 and 17; and the antenna's E-plane at the same different frequency bands is shown in FIGS. 6, 8, 10, 12, 14, 16 and 18. Measurements were made in such a way that the direction perpendicularly outward from the back of the mobile phone is directed in the angle position marked 0 degrees in the FIGS., while the angle position marked 180 degrees in the FIGS. indicates the direction toward the head of an operator of the mobile phone. The radiation diagrams were measured with the antenna mounted on a copper back plate as shown in FIGS. 2A and 2B, and the measurements were done in a "free position".

Figure 19:
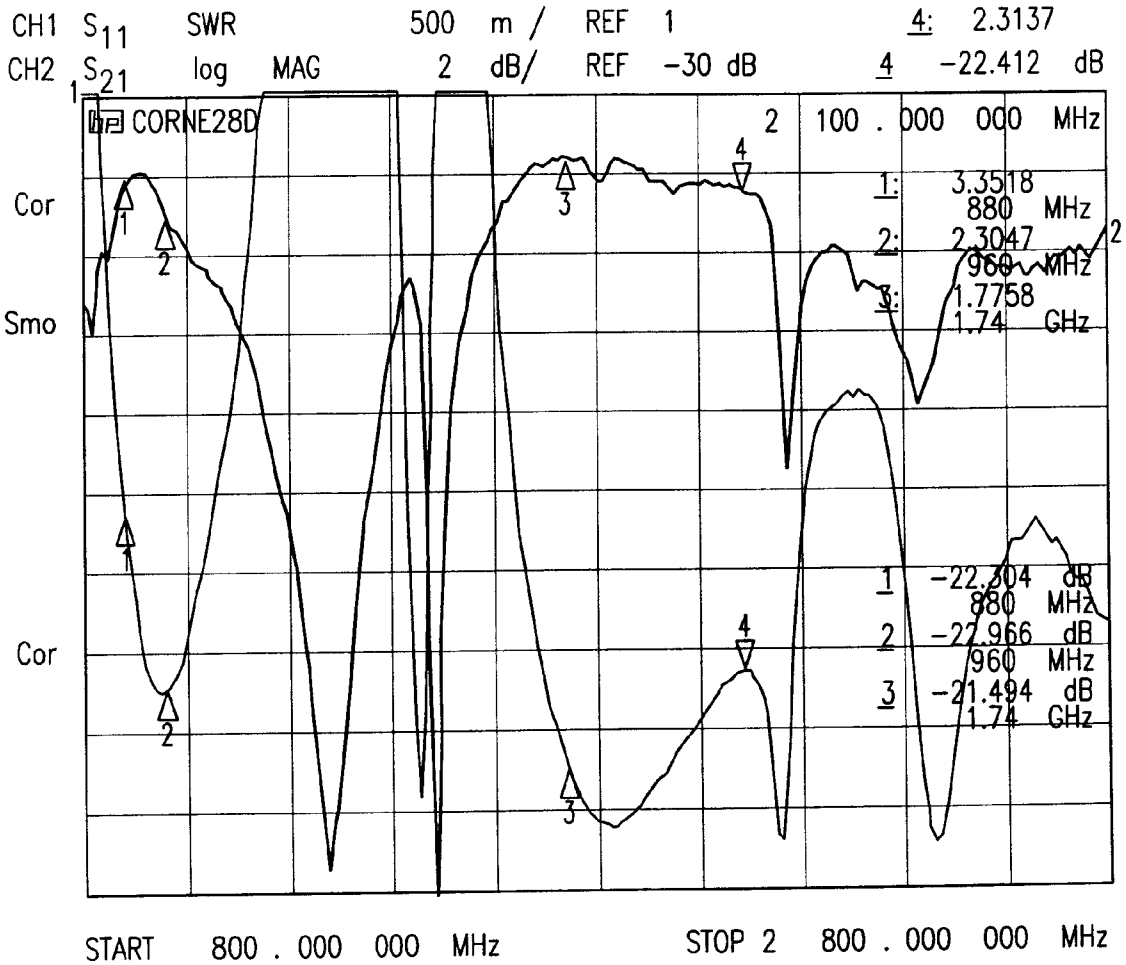
FIG. 19 is a diagram that illustrates an example of a VSWR curve and a radiation curve for a "Multiband Feedback Patch Antenna" apparatus according to an embodiment of the present invention.
Figure 20:
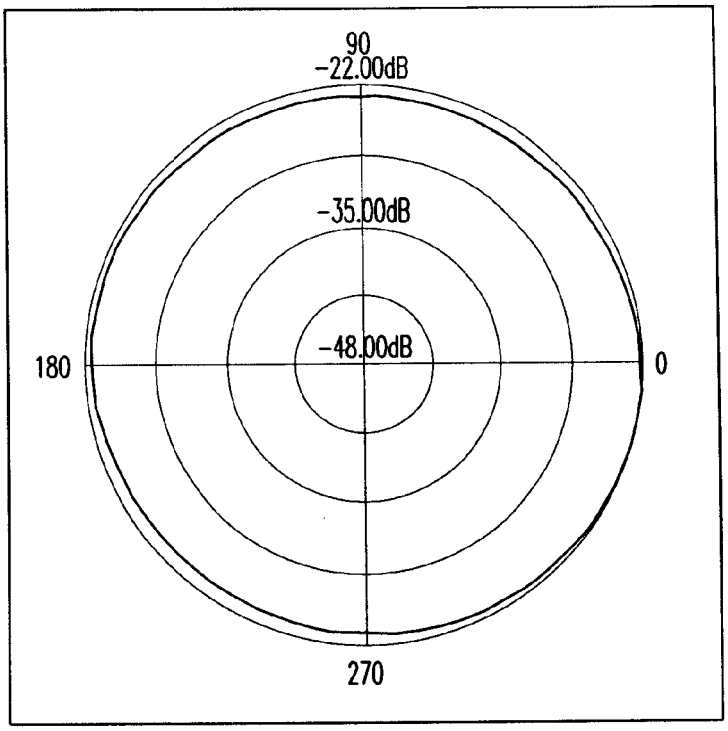
FIGS. 20–31 are measured radiation diagrams for the Multiband Feedback Patch Antenna apparatus described with reference to FIG. 19.
Figure 21:
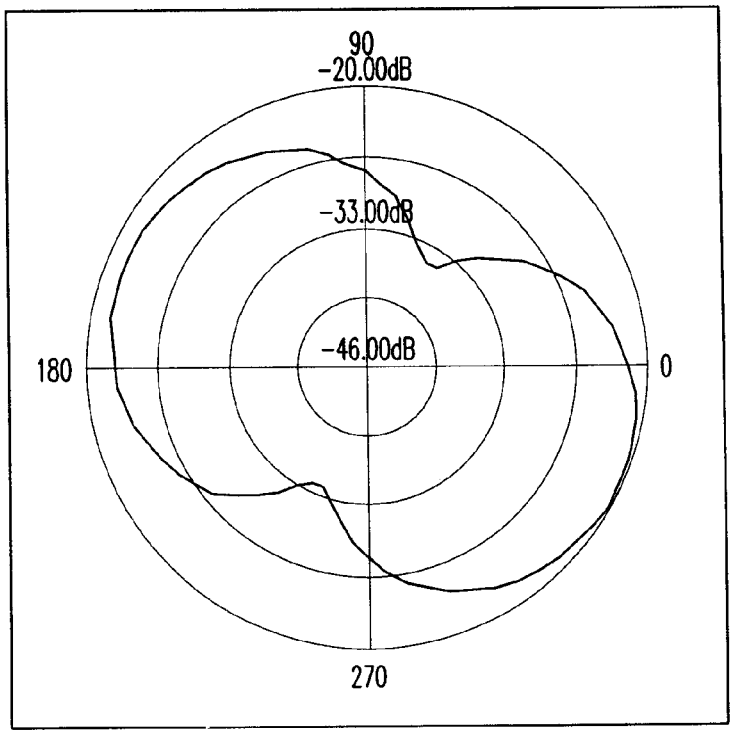
Figure 22:
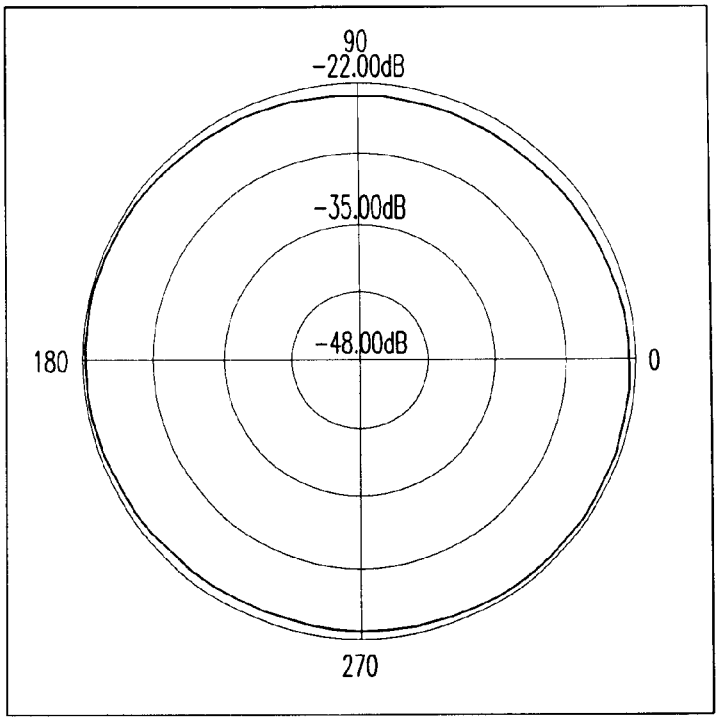
Figure 23:
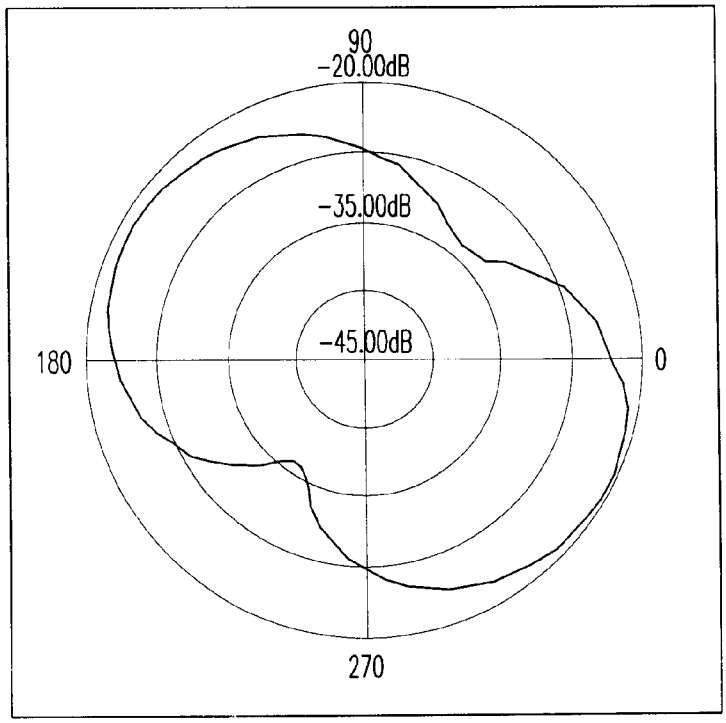
Figure 24:
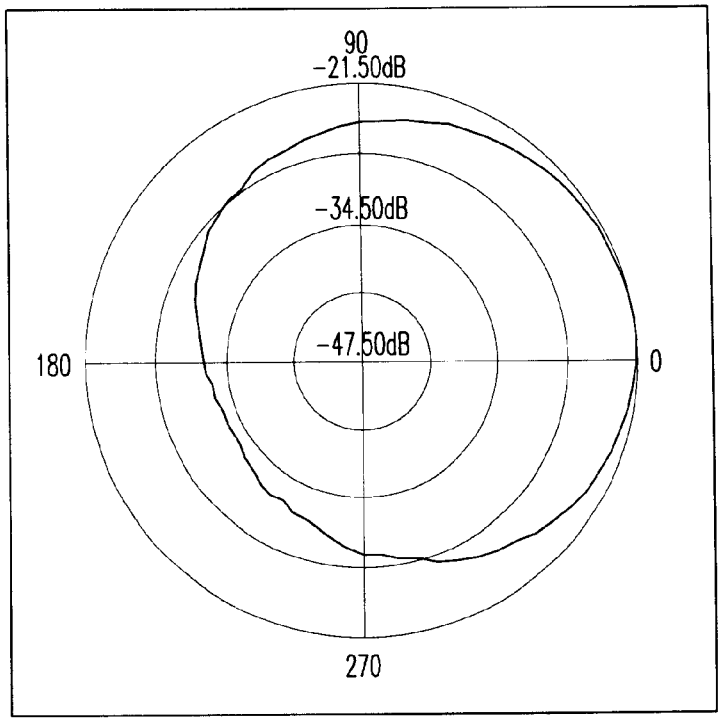
Figure 25:
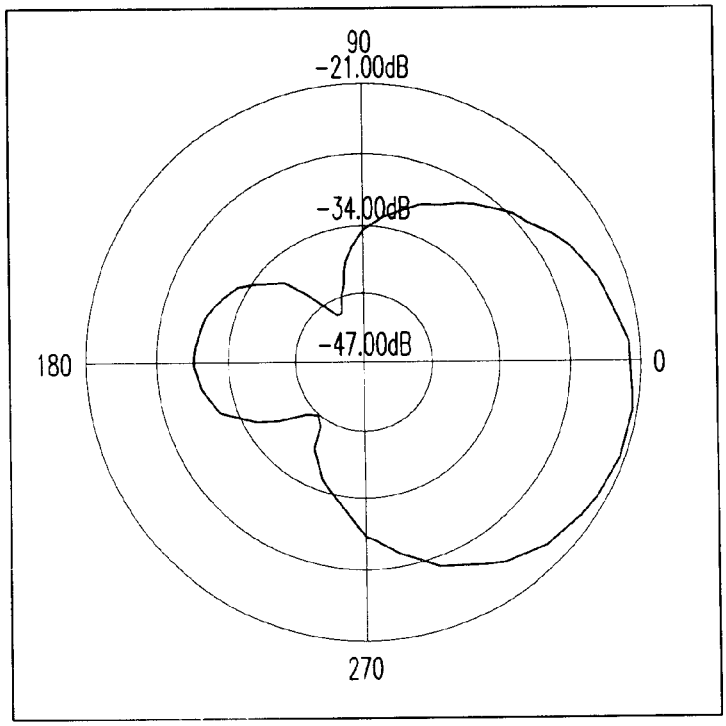
Figure 26:
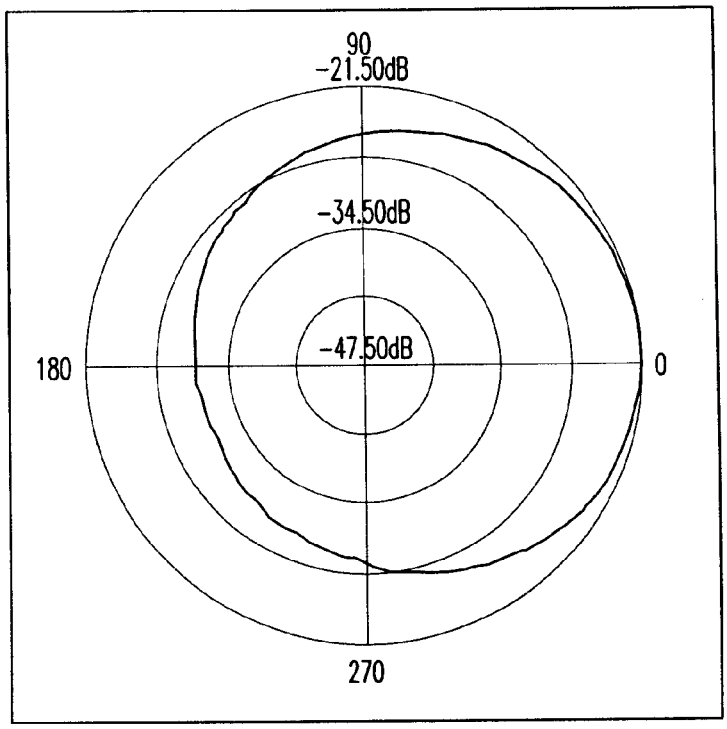
Figure 27:
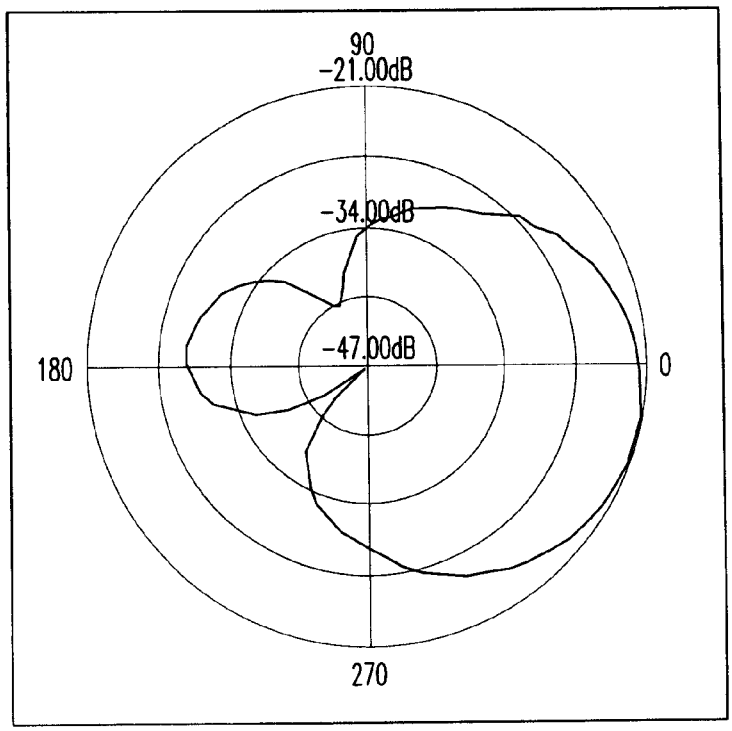
Figure 28:
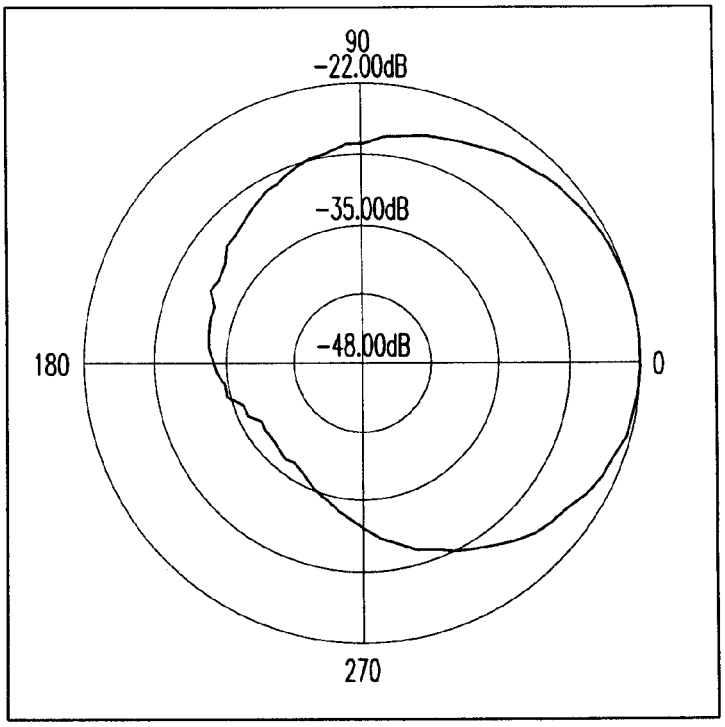
Figure 29:
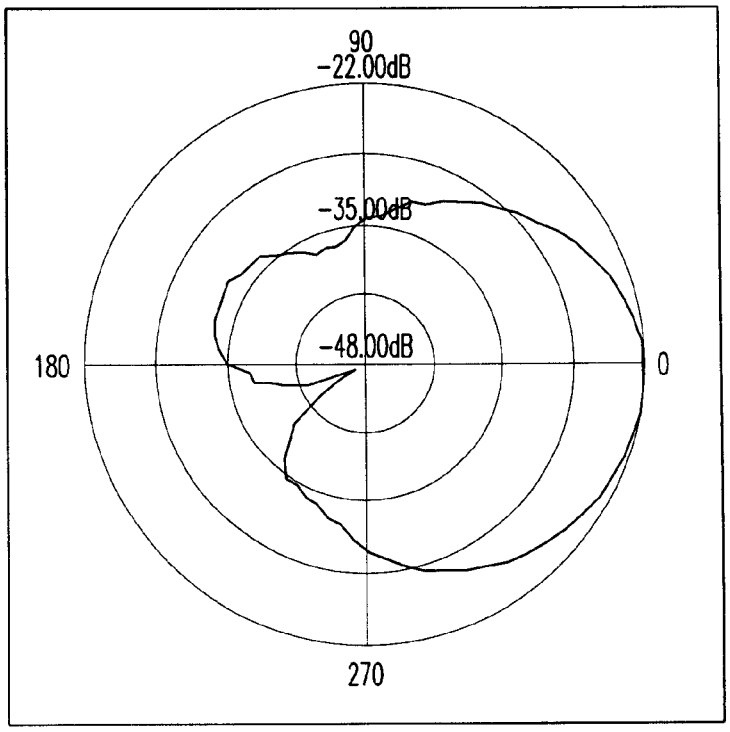
Figure 30:
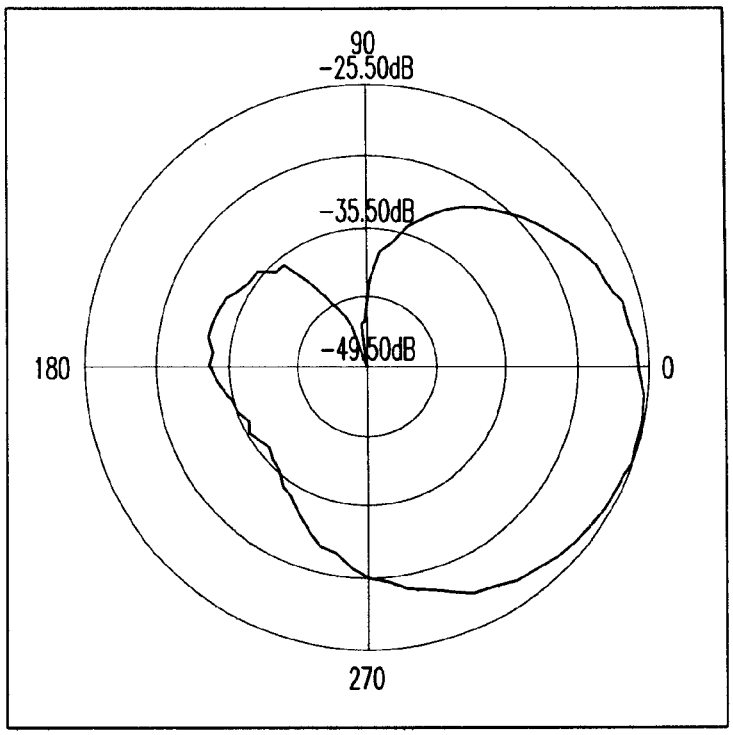
Figure 31:
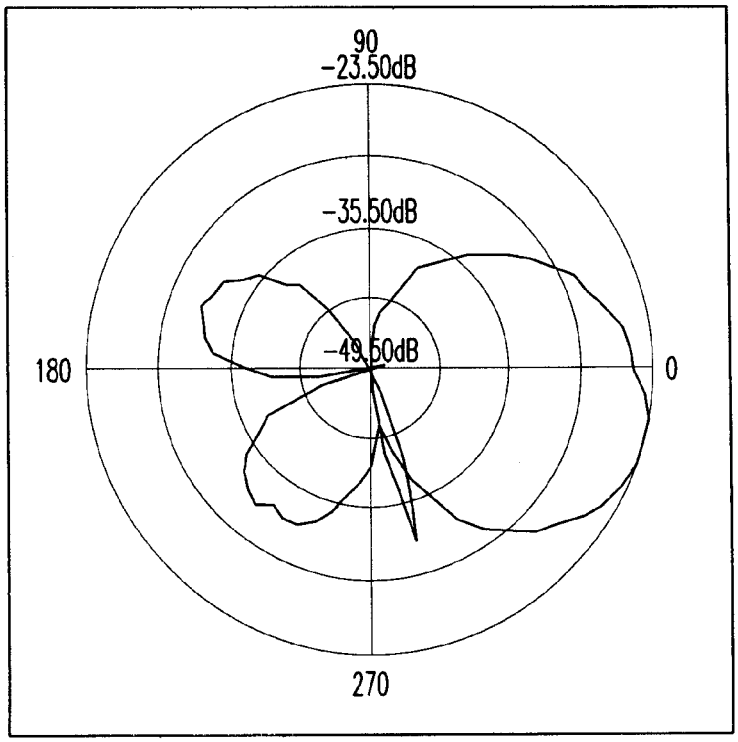

As indicated above, the feedback patch antenna apparatus according to the present invention can also be given frequency characteristic of the "Multiband" type if the probe feed point and the grounding point are properly chosen. FIG. 19 is an $S_{11}/S_{12}$ diagram illustrating an example of a VSWR curve (solid line) and a radiation curve (dashed line) for a "Multiband Feedback Patch Antenna" according to the present invention (again wherein the patch antenna has a height of 32 mm). The radiation curve is again measured in the direction perpendicularly outward from the back side of the mobile telephone.

FIGS. 20–31 are measured radiation diagrams for the "Multiband Feedback Patch Antenna" described with reference to FIG. 19. FIGS. 20, 22, 24, 26, 28 and 30 illustrate measurements at different frequency bands in the antenna's H-plane; and FIGS. 21, 23, 25, 27, 29 and 31 illustrate measurements at the same different frequency bands in the antenna's E-plane. As in the radiation diagrams illustrated in FIGS. 5–18, the measurements were made in such a way that the direction perpendicularly outward from the back of the mobile phone is directed in the angle position marked 0 degrees, while the angle position marked 180 degrees indicates the direction toward the head of an operator of the mobile phone. The radiation diagrams were measured with the antenna mounted on a copper back plate as shown in FIGS. 2A and 2B, and the measurements were done with the antenna apparatus in a "free position".

A review of the data relating to the "Broadband" and the "Multiband" feedback patch antenna types described above indicates the following:

For the Broadband Feedback Patch Antenna Type

1. The impedance matching of the antenna to 50-ohms is good in the measured frequency bands.
2. The radiation level in the direction pointing perpendicularly out from the back side of the mobile phone is generally satisfactory.
3. Some improvement in the directivity of the antenna beam at the 900 MHz frequency band may be desirable.
4. As the major portion of the ground plane (the chassis of the mobile phone) is situated below the antenna, this will influence the boresight of the radiation pattern to take a somewhat depressed angle.
5. The deviations from optimum data described in items 3 and 4 above are physically determined and appear to not be of great importance.

For the Multiband Feedback Patch Antenna Type

1. The impedance matching of the antenna to 50-ohms should be improved somewhat, particularly at 880 MHz.
2. The radiation level in the direction pointing perpendicularly outwardly from the back side of the mobile phone is generally satisfactory; and, particularly in the frequency band 1710–2110 MHz, extremely strong radiation is found thanks to directivity.
3. Items 3, 4 and 5 above with respect to the Broadband type antenna also apply to the Multiband type antenna.

As shown by the measurement data described above, a Feedback Patch Antenna having a reduced height of 32 mm, and constructed as illustrated in FIGS. 2A and 2B, provides generally satisfactory operating characteristics at the frequency bands of interest. The data also indicates that satisfactory characteristics can be achieved with an even smaller Feedback Patch Antenna. For example, further reducing the height to 25 mm will result in a reduction in the antenna gain of only about 1 dB. Although the height reduction will also result in a somewhat reduced bandwidth, considering the bandwidth, the margins are still relatively good. Yet a further reduction in the height from 25 mm to 23 mm will lead to a further reduction in antenna gain of about ½ dB. The operation of these smaller patch antennas will be described more fully hereinafter.

When designing an antenna to have outstanding operating characteristics, it is important that all mechanical data and tolerances be well-established. This is especially important in connection with mass production procedures and also to ensure good reproducibility. When it is desired to design an antenna having a high gain combined with small mechanical dimensions, it is relatively easy to obtain an undesirable reactive near field, which will prevent obtaining a large bandwidth. Accordingly, for a miniaturized multiband antenna, it is important to establish how the different parameters must be adjusted and combined; and, also, to stipulate the tolerances to achieve the desired radiation characteristics, including high gain and good impedance matching for all frequency bands of interest. When it is considered that all this must be achieved while maintaining the antenna within a considerably limited volume and within a given environment, it can be appreciated that the design work has been rather difficult and time-consuming to achieve.

Figure 32:
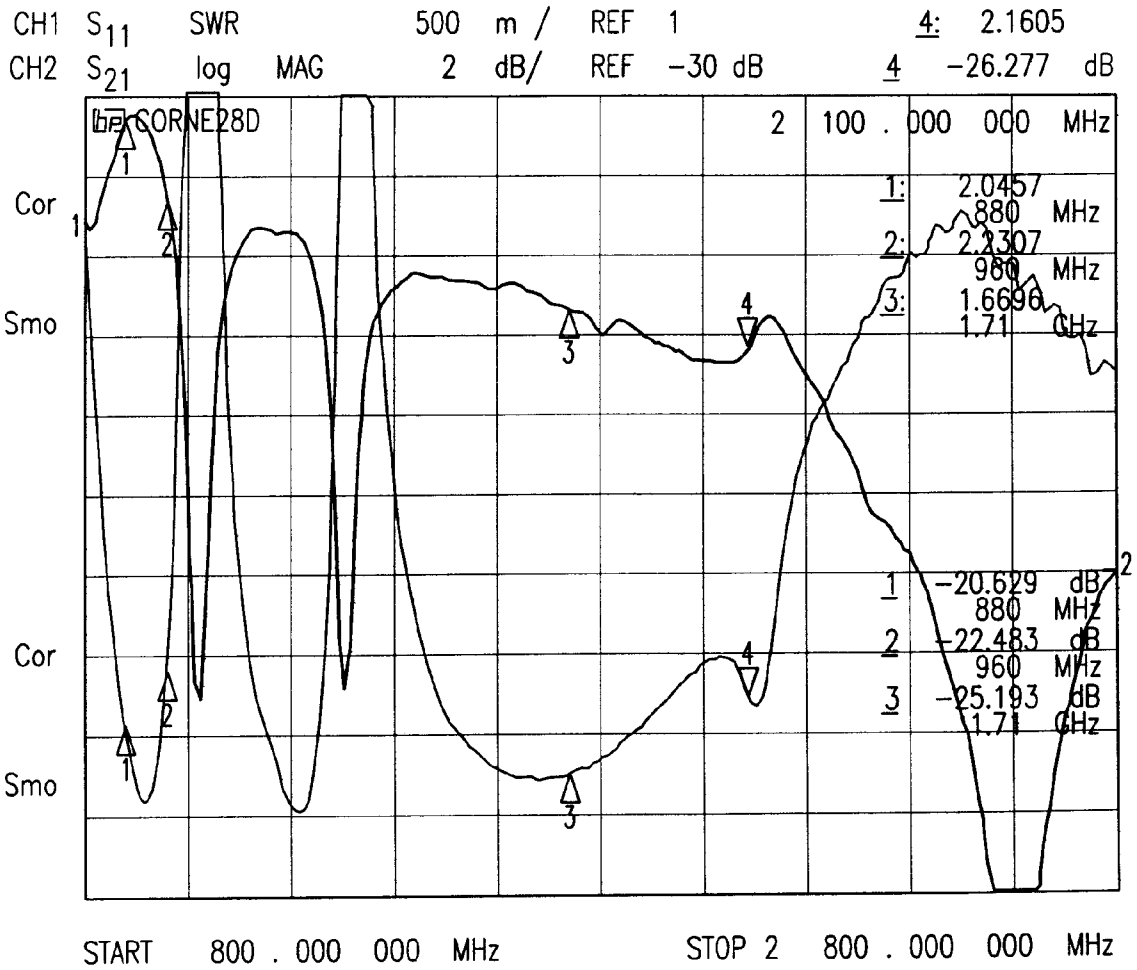
FIG. 32 is a diagram that illustrates an example of a VSWR curve and a radiation curve for a Multiband Feedback Patch Antenna apparatus according to a further embodiment of the present invention.
Figure 33:
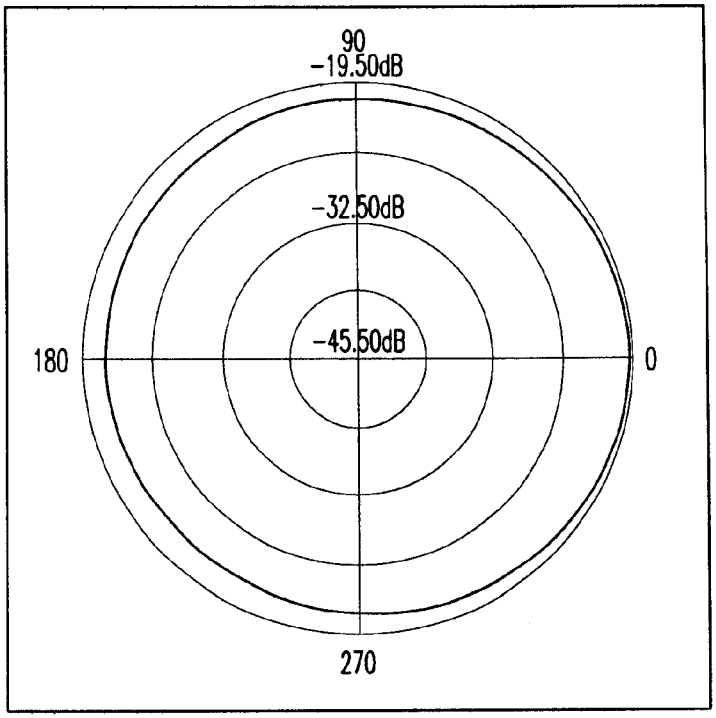
FIGS. 33–44 are measured radiation diagrams for the Multiband Feedback Patch Antenna apparatus described with reference to FIG. 32.
Figure 34:
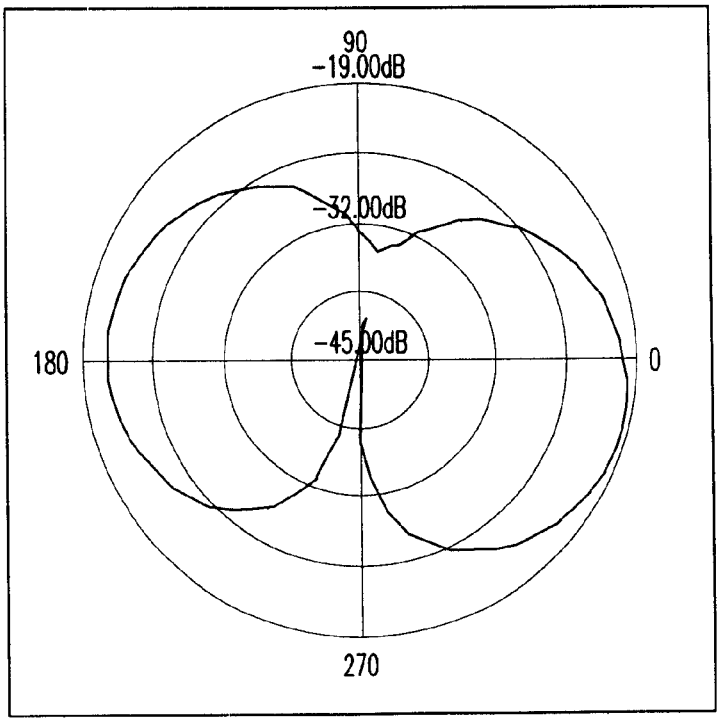
Figure 35:
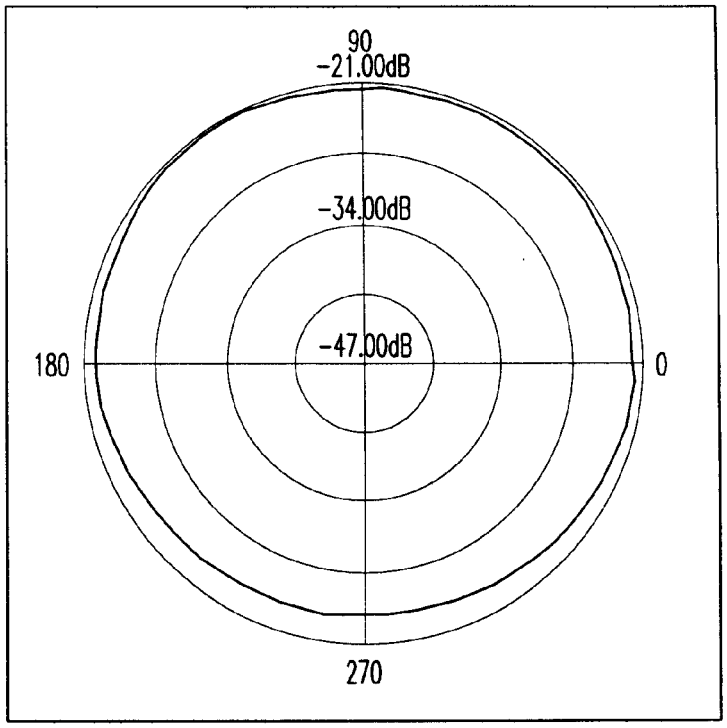
Figure 36:
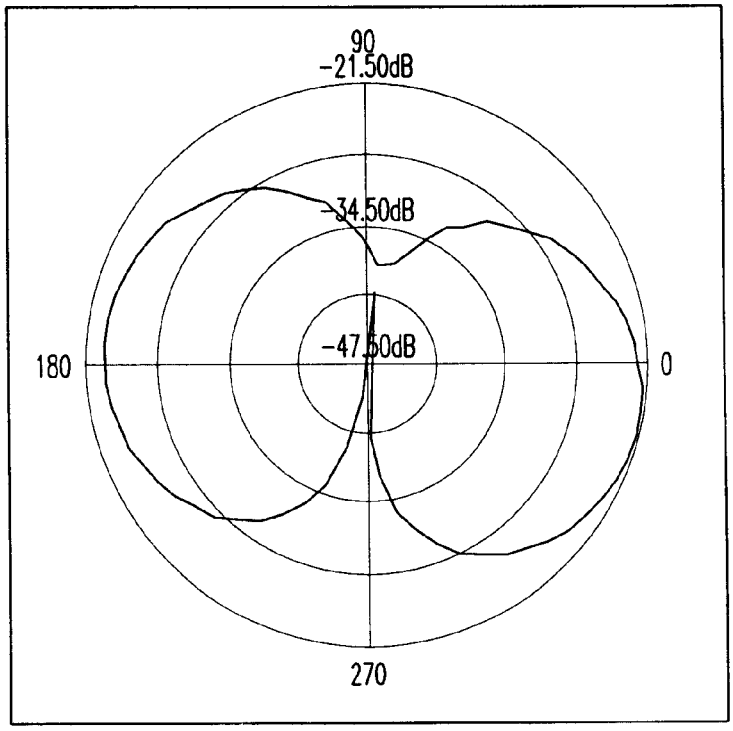
Figure 37:
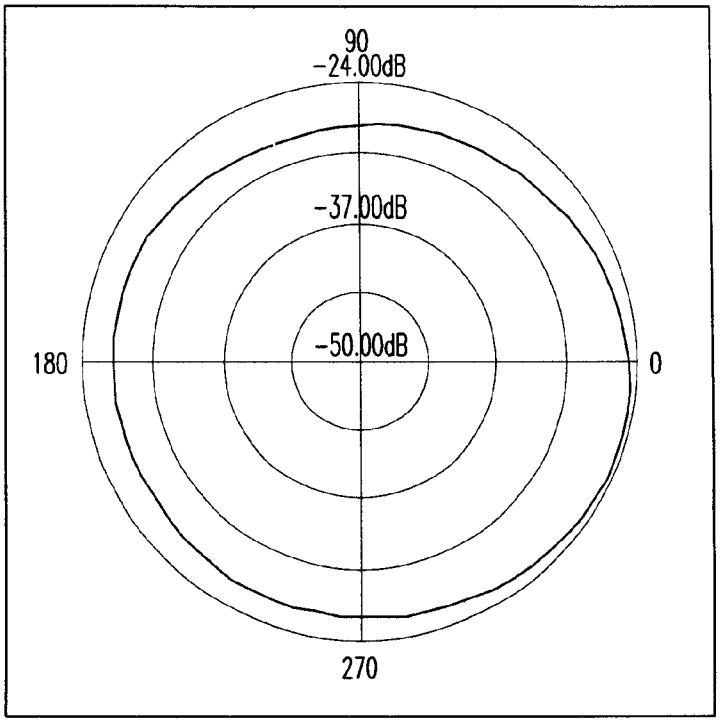
Figure 38:
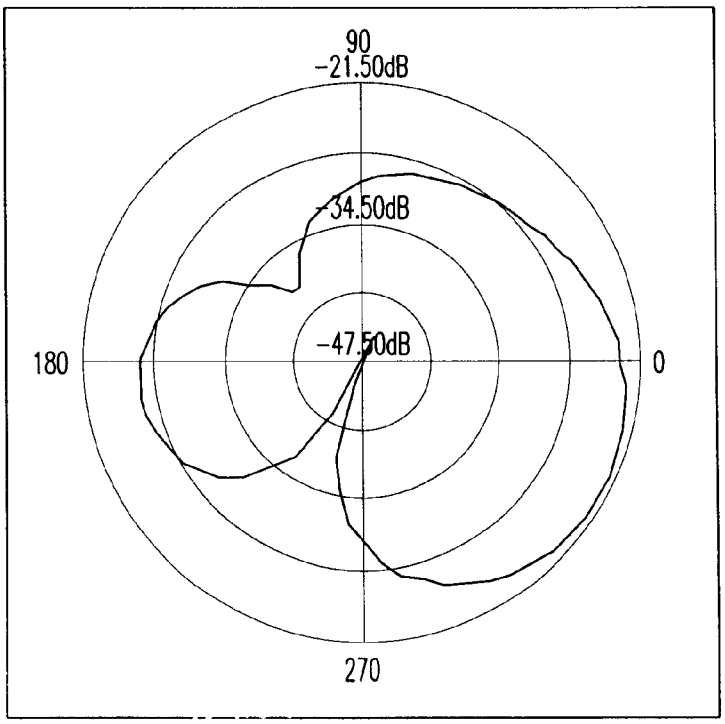
Figure 39:
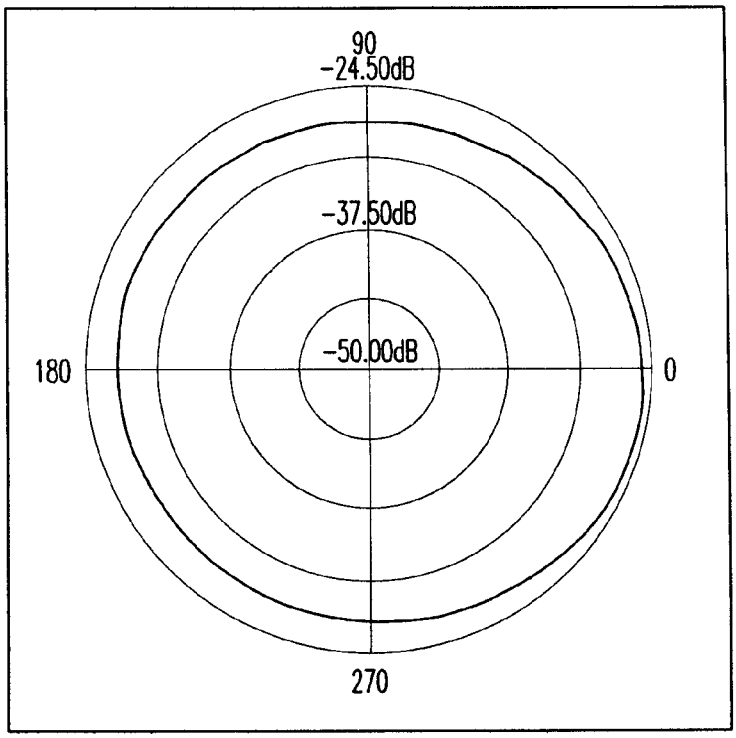
Figure 40:
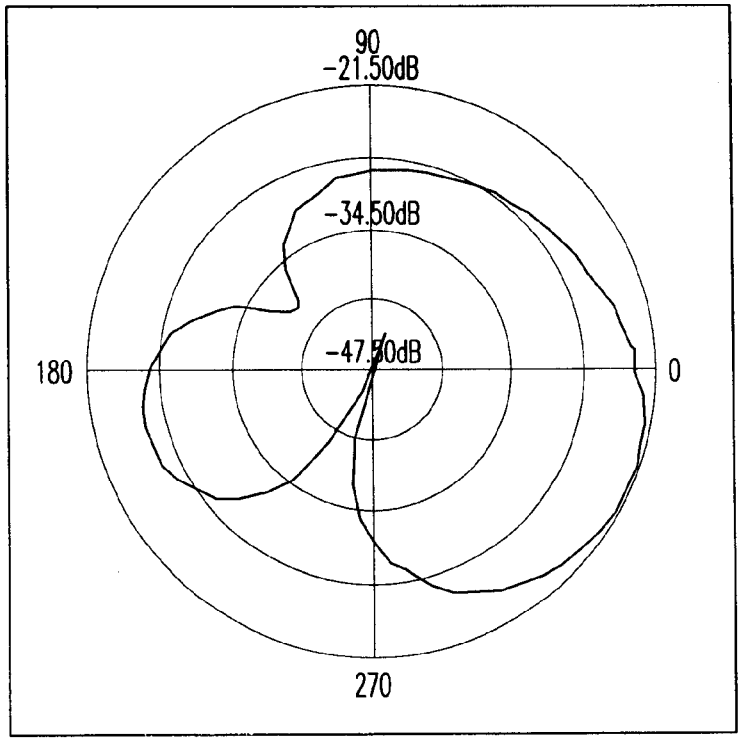
Figure 41:
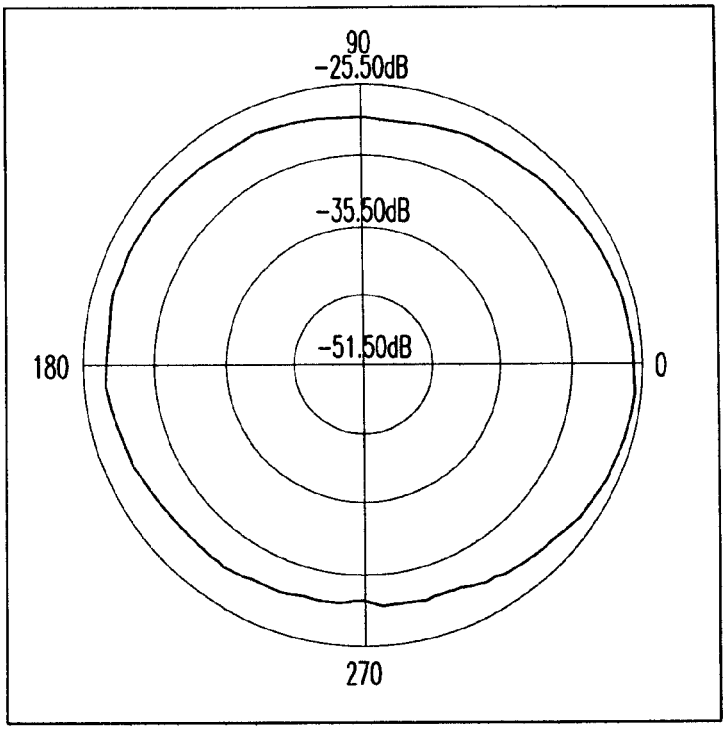
Figure 42:
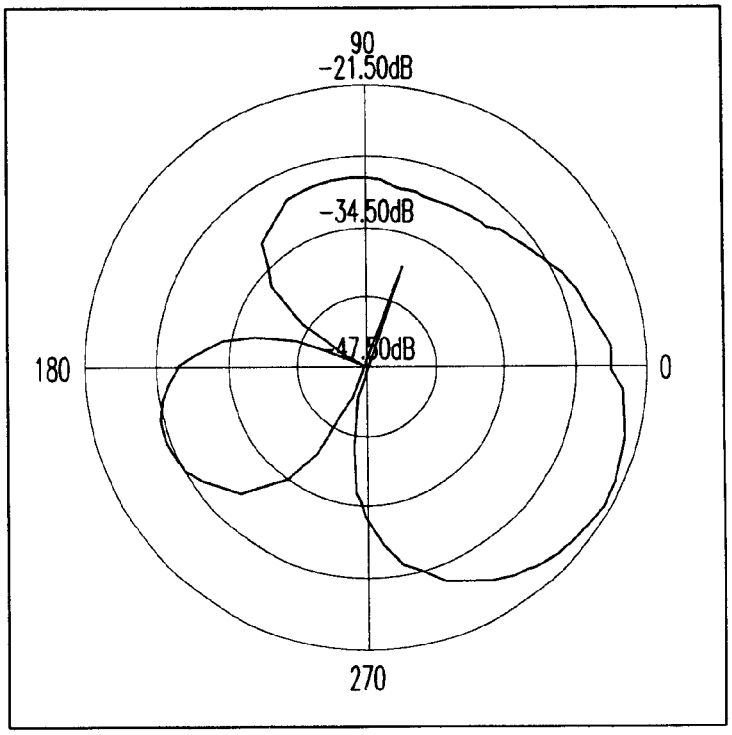
Figure 43:
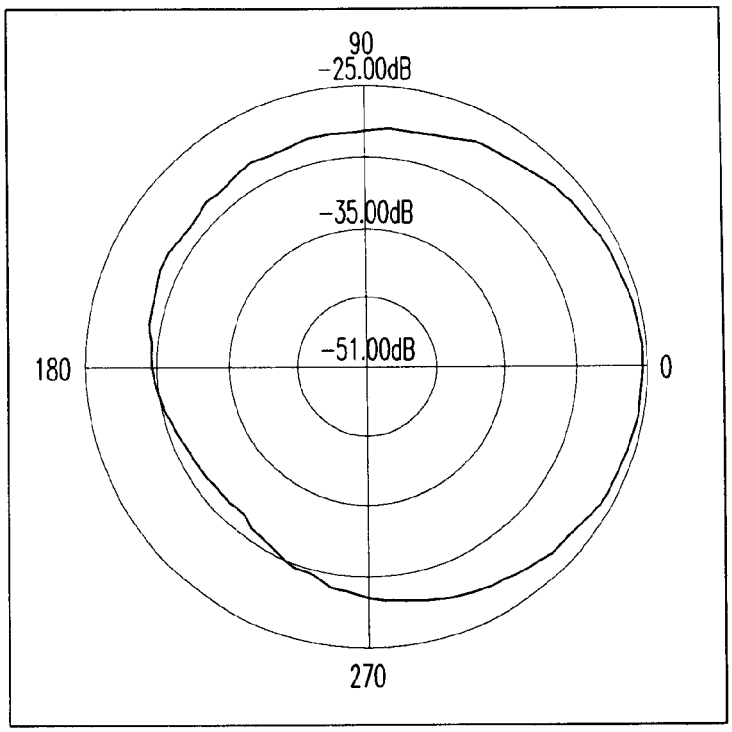
Figure 44:
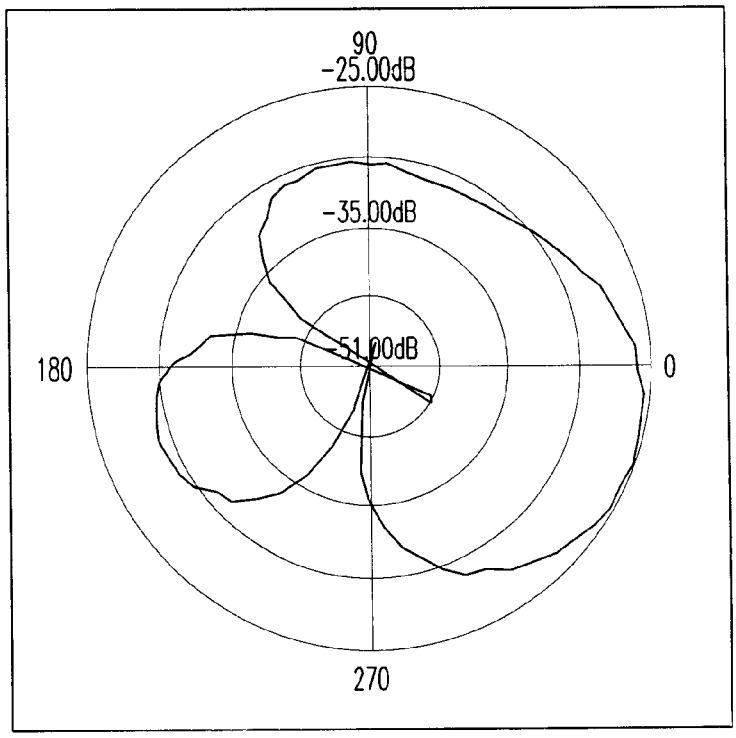

An antenna apparatus similar in design to that illustrated in FIGS. 2A and 2B was further reduced in size to have the external dimensions 40×25×10 mm, and this antenna was designed to give the typical characteristics of a "Feedback Multiband Patch Antenna". FIG. 32 is an $S_{11}/S_{12}$ diagram for this antenna where $S_{11}$=VSWR (in solid line) and $S_{12}$=radiation (in dashed line). The radiation graph was measured in the direction perpendicularly outward from the back side of the mobile phone.

FIGS. 33–44 are measured radiation diagrams measured with the antenna installed on a copper back plate having dimensions 100×45×0.5 mm and in a "free position". FIGS. 33, 35, 37, 39, 41 and 43 illustrate radiation patterns for different frequencies in the H-plane; and FIGS. 34, 36, 38, 40, 42 and 44 illustrate radiation patterns for the same different frequencies in the E-plane.

Figure 45:
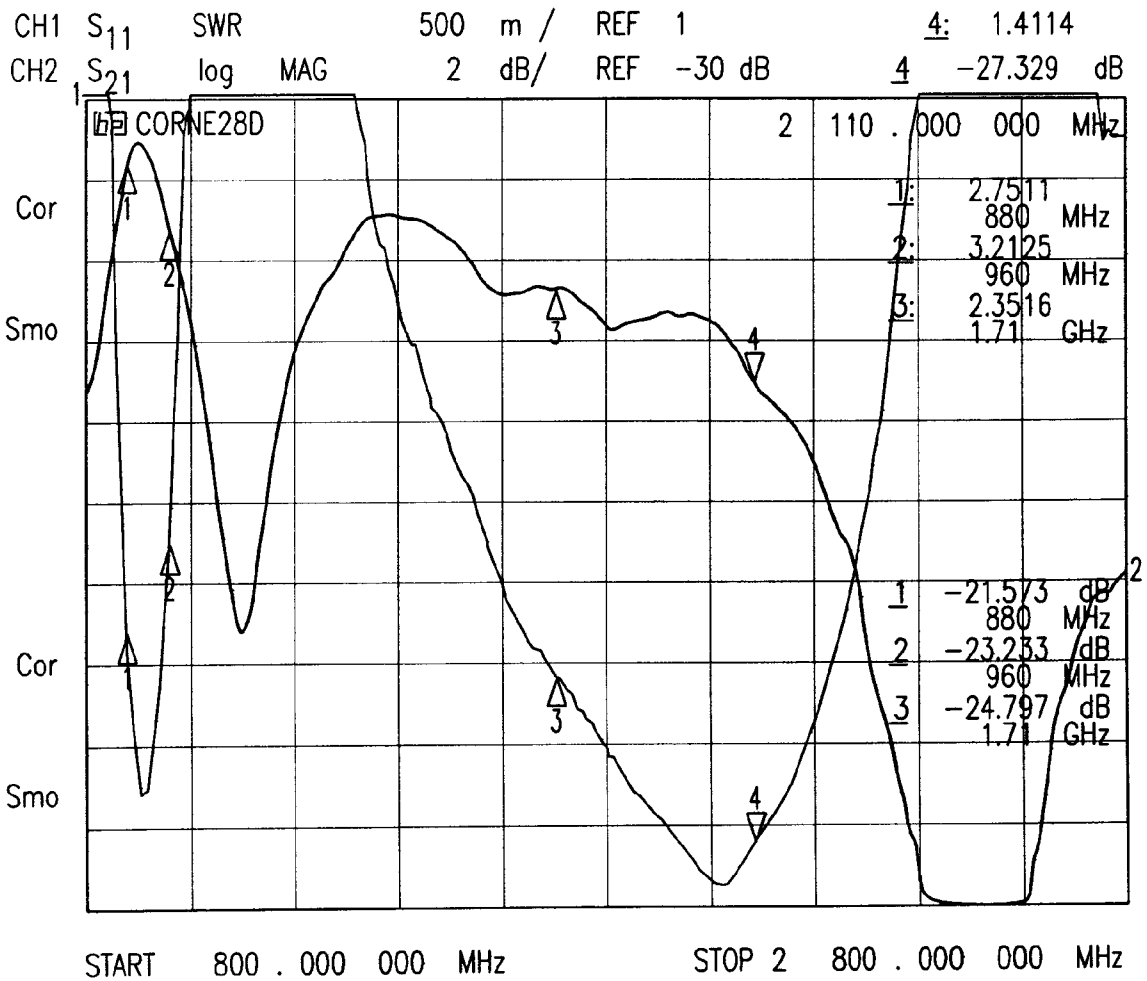
FIG. 45 is a diagram that illustrates an example of a VSWR curve and a radiation curve for a Multiband Feedback Patch Antenna apparatus according to a further embodiment of the present invention.
Figure 46:
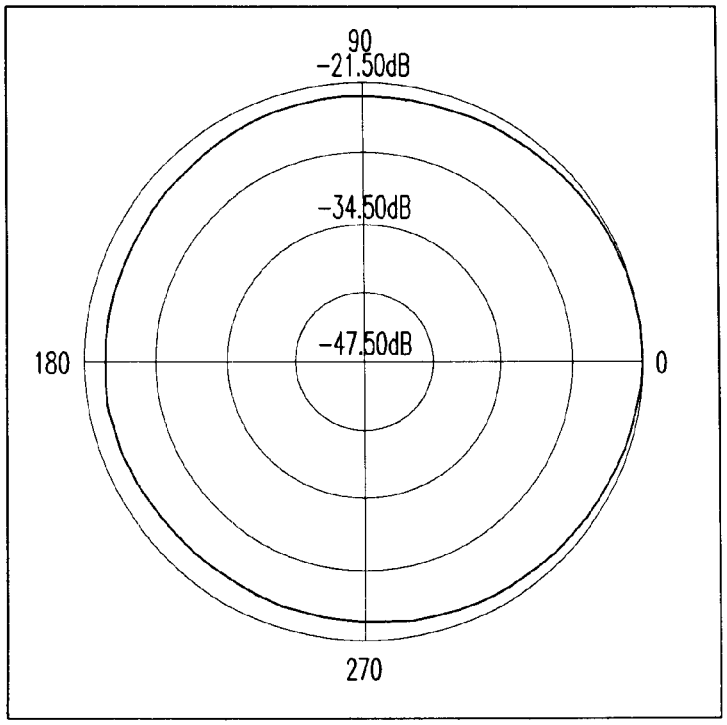
FIGS. 46–53 are measured radiation diagrams for the Multiband Feedback Patch Antenna apparatus described with reference to FIG. 45.
Figure 47:
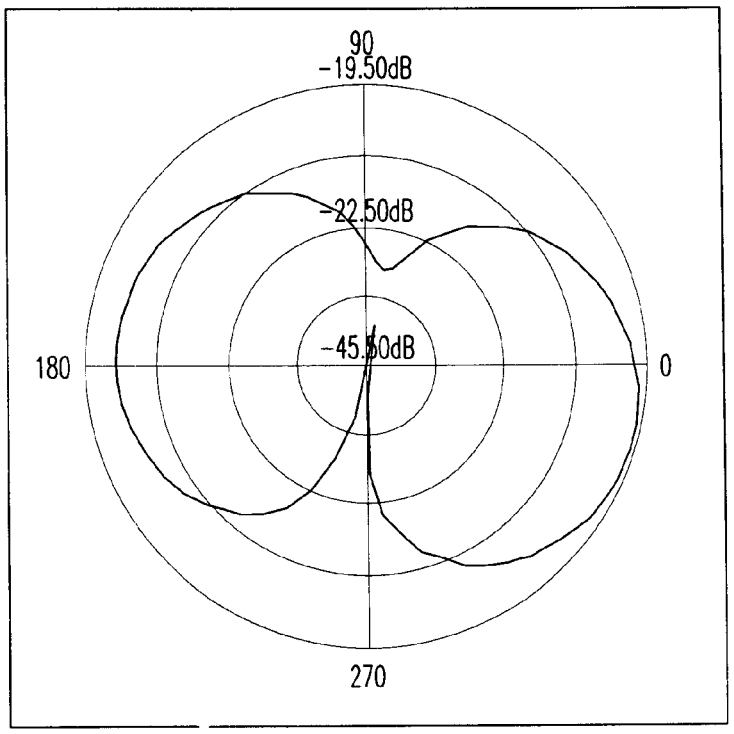
Figure 48:
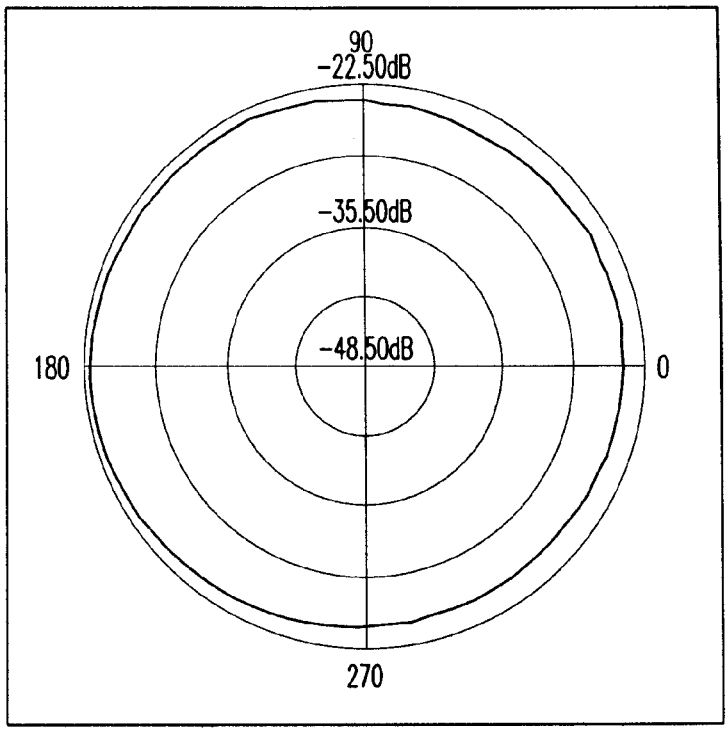
Figure 49:
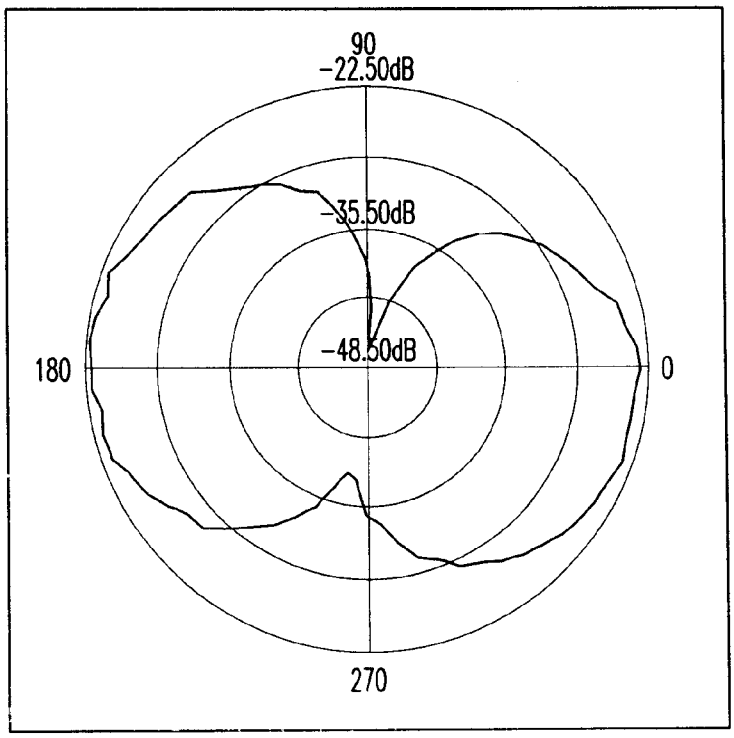
Figure 50:
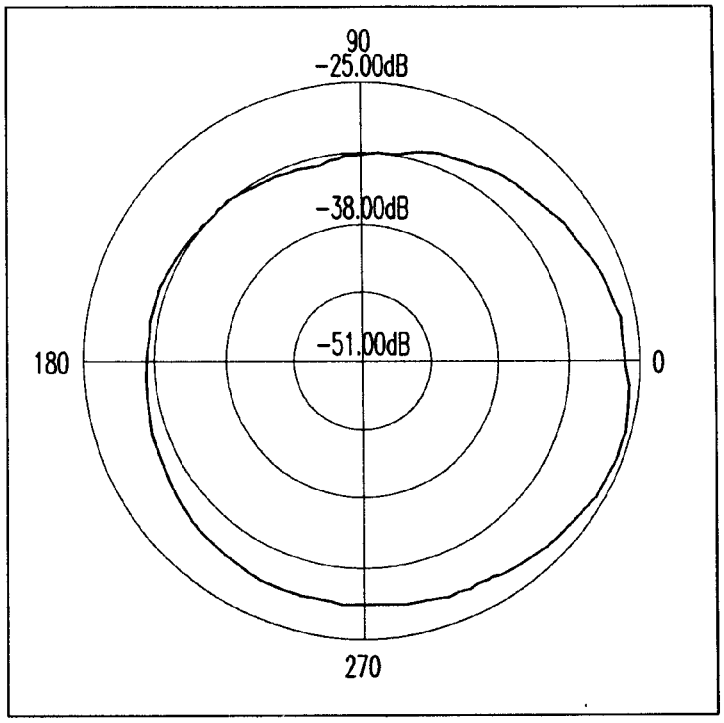
Figure 51:
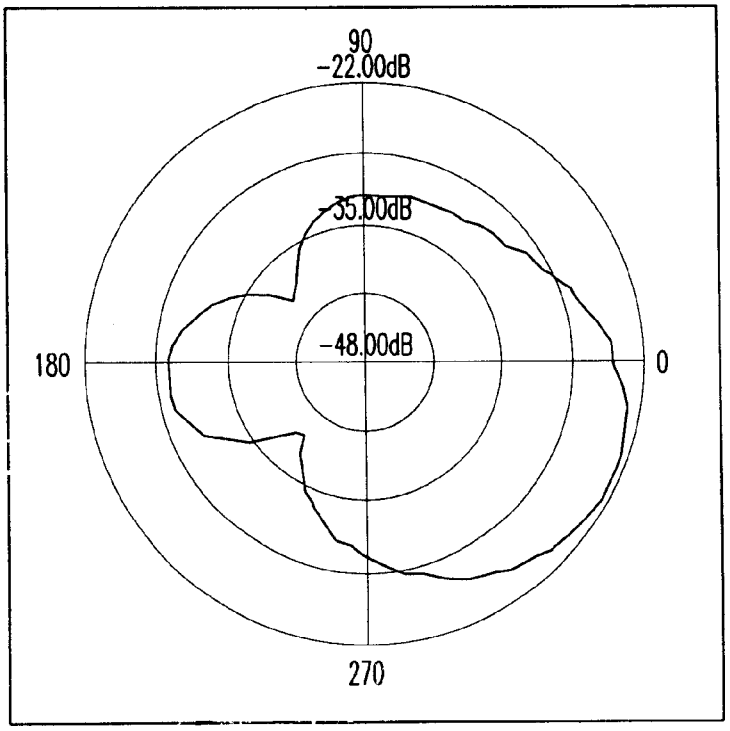
Figure 52:
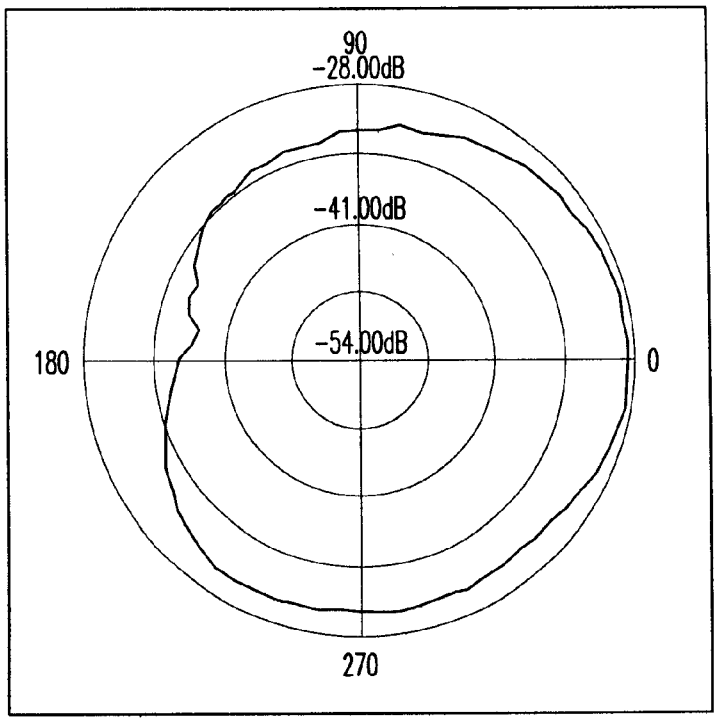
Figure 53:
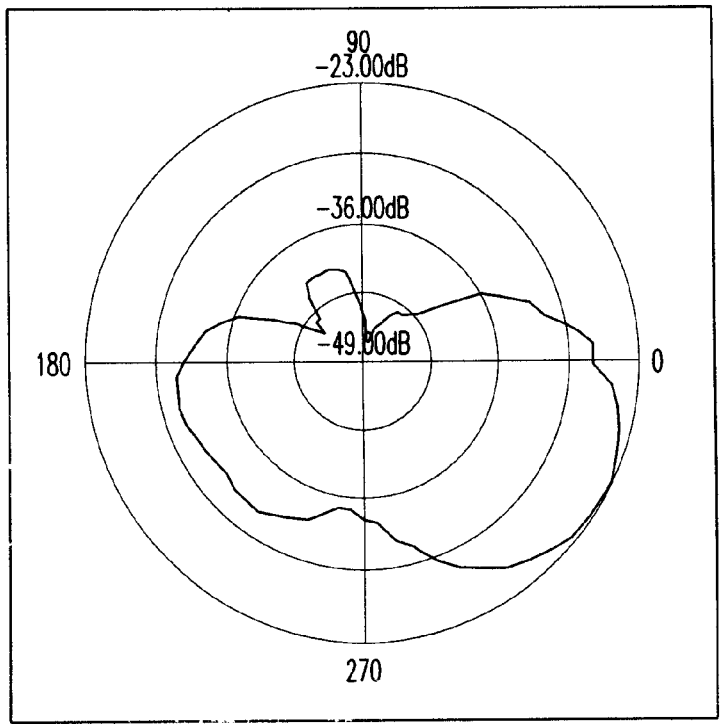

FIG. 45 is an $S_{11}/S_{12}$ graph for a "Feedback Multiband Patch Antenna" according to the present invention that has been further reduced in size to have the dimensions 41×19×9 mm. Again, the VSWR curve is shown in solid line and the radiation curve in dashed line. Again also, the radiation was measured in the direction perpendicularly outward from the back side of the mobile phone. FIGS. 46–53 are measured radiation diagrams for this antenna design measured as before with the antenna installed on a copper plate having dimensions 100×45×0.5 mm and in a "free position". FIGS. 46, 48, 50 and 52 are radiation plots at different frequencies measured in the H-plane and FIGS. 47, 49, 51 and 53 are radiation plots at the same different frequencies measured in the E-plane.

The above diagrams establish that a miniaturized patch antenna having dimensions at least as small as 41×19×9 mm can be provided that has very good operating characteristics for the frequency bands 880–960 MHz, 1570–1580 MHz and 1710–2170 MHz. While not quite as good, the antenna can also be used for the frequency band of 2400–2500 MHz, if desired.

The patch antenna apparatus described above was formed from a punched and folded copper plate and a feed probe. The tested antennas were installed on a copper plate having dimensions of 100×45×0.5 mm. If the antenna is installed in a mobile phone instead of on a plate, it is believed that the front/back ratio of the radiation from the patch antenna at the lowest frequency band can be improved. The miniaturized antennas, in particular, can be manufactured in a printed card design, if desired. In this regard, a printed card feedback multiband stub antenna installed on top of a mobile phone can be utilized as an omnidirectional receiving antenna with good reception properties, i. e., good standby, whether the mobile phone is placed on a table or in one's pocket, for example. The design will also provide a high degree of isolation to a Multiband Patch Transmitter Antenna if it is installed within the mobile phone and has good directivity outwardly from the back side of the mobile phone.

It is also possible, in the case of a multiband mobile phone, to avoid the use of expensive and sensitive components such as filters and switches by providing separated multiband miniaturized antennas for reception and transmission. The mobile phone's own control system can also be utilized to switch on and off the unused frequency bands in the antenna on both the transmitter side and the receiver side as will be described more fully hereinafter.

Figure 54:
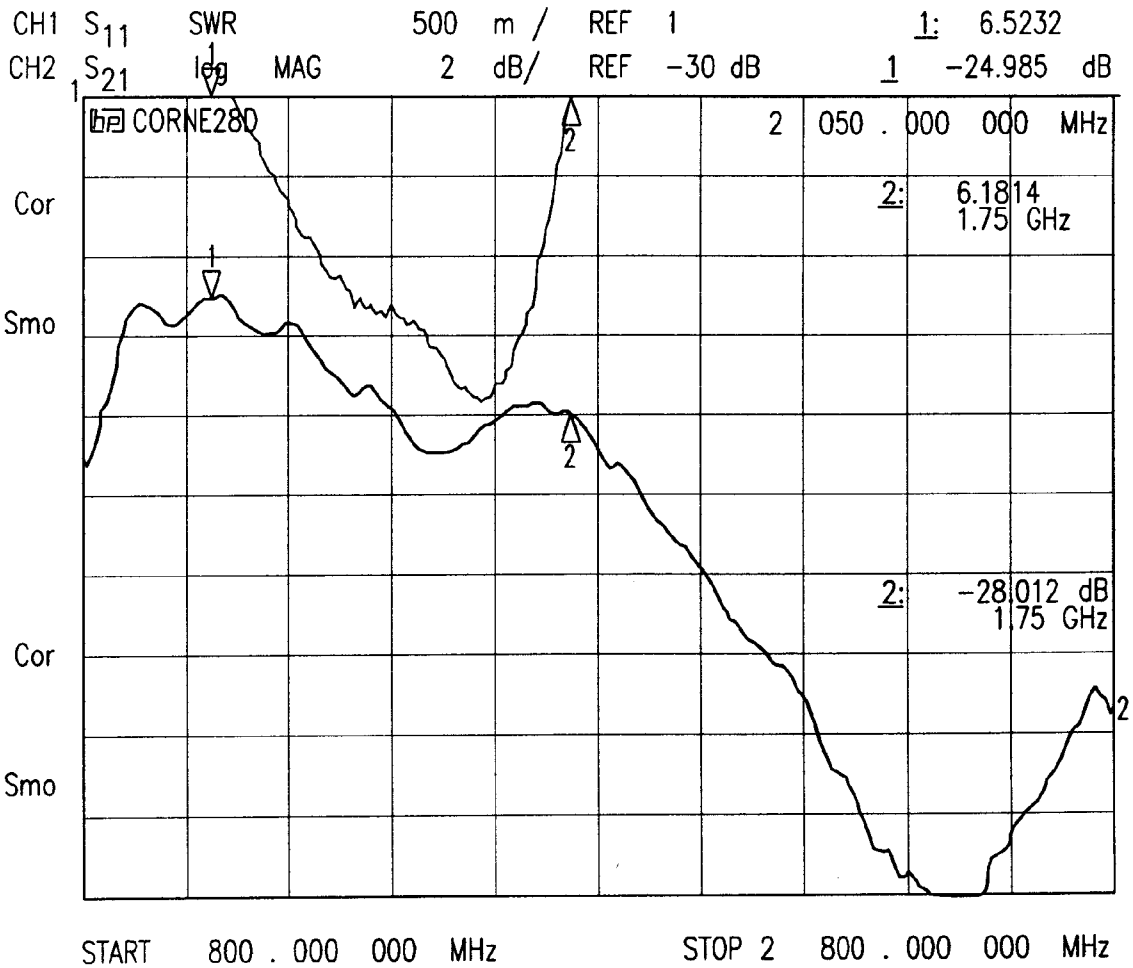
FIG. 54 is a diagram that illustrates an example of a VSWR curve and a transmission curve for a Multiband/Broadband Feedback Patch Antenna apparatus according to another embodiment of the present invention.

FIG. 54 is a diagram illustrating a measured impedence curve (VSWR, solid line) and a transmission curve (dashed line) for a multiband/broadband feedback patch antenna having dimensions of 42×19/23×8/10 mm. The diagram shows a broadband transmission from about 800 MHz to more than 2000 MHz out from the patch antenna in the direction perpendicular to the antenna surface. The impedance match to a 50-ohm transmission line is broadband but not particularly good, the VSWR-values are worse than 4:1. The reason for this is, partly, that the radiating slots are parallel to one another and, in terms of wavelength, very close to each other, for which reason, the mutual coupling is considerable. The main reason, however, is that the dimensions of the patch are so small that the length of the slots is not sufficient for the first resonance $\lambda/2$.

It has been shown, however, that the length of the slots of a patch antenna apparatus can, under certain circumstances, be enlarged beyond the width (in this case 42 mm) of the patch portions by expanding symmetrically around the corners of the patch surface and continuing down the sides of the patchline for a distance such that the total length of the slot reaches a length corresponding to the length of the half-wave within a frequency band of interest. This means that a resulting half-wave resonance with a center frequency at approximately 1600 MHz in the size of the patch is maximally utilized, and corresponds with the measurements. However, matching to a 50-ohm system is not adequate, and the matched frequency band occurs above the desired 900 MHz frequency band.

One way to improve the matching to 50-ohms at desired frequency bands is impedance matching in connection with the antenna feedpoint. Another way is by appropriate extension and impedance loading of the radiating antenna slots. According to a further embodiment of the invention, extension and impedance loading of the slots of the antenna apparatus is applied to one or both sides of the inner and outer patch portion surfaces at the metallic wall connector portion therebetween. In particular, two thin copper strips, one on each side of the patch antenna was found to solve the problem with the slots' half-wave resonance and give a good impedance match to the connected 50-ohm system.

Inasmuch, however, as the antenna must be matched at, at least, two frequency bands, e.g., partly at 880–960 MHz and partly at 1710–2170 MHz, the question arises as to whether the extension on one side can give good impedance matching for the lower frequency band and the extension on the other side can give good impedance matching for the higher frequency band? It has been determined that this is, in fact, the case.

Impedance matching of the miniaturized patch antenna apparatus via matching of its excited slots by connecting thin copper strips to achieve extensions and impedance loading to the slots can be mechanically realized in many ways. Whatever the mechanical realization, however, three criteria should be satisfied:

1. Because the antenna apparatus is a miniaturized patch antenna, the added matching structure should not enlarge the size of the patch portions to any appreciable extent.
2. The antenna apparatus must be designed in such a way that it is adapted for mass production.
3. The patch antenna apparatus must be easily reproducible and cost effective.

According to an embodiment of the present invention, the above criteria are satisfied by locating the matching copper strips quite close to the sides of the patchline (space =about 1 mm) and positioning the strips in planes that are perpendicular to the surfaces of the patch portions. The matching strip on one side of the patch portions is relatively long for impedance matching at the low frequency band, and the matching strip on the other side is relatively short for impedance matching at the high frequency band. The strips start from opposite sides of the metallic wall connector of the patch antenna. To reduce the length of the longer strip, it can be partially shaped as a square wave (meandering), a sine wave or a zig-zag wave; and located in a plane perpendicular to the surfaces of the patch portions. The width of the shaped copper strip is less than the thickness of the patch antenna.

For the shorter matching copper strip for impedance matching at the high frequency band, it is enough to use a straight copper strip along and close to the patchline. As the longer strip on the opposite side, this shorter strip is located in a plane perpendicular to the surfaces of the patch portions. The shorter strip terminates at the upper corner of the outer patch portion where it is grounded.

Figure 55A:
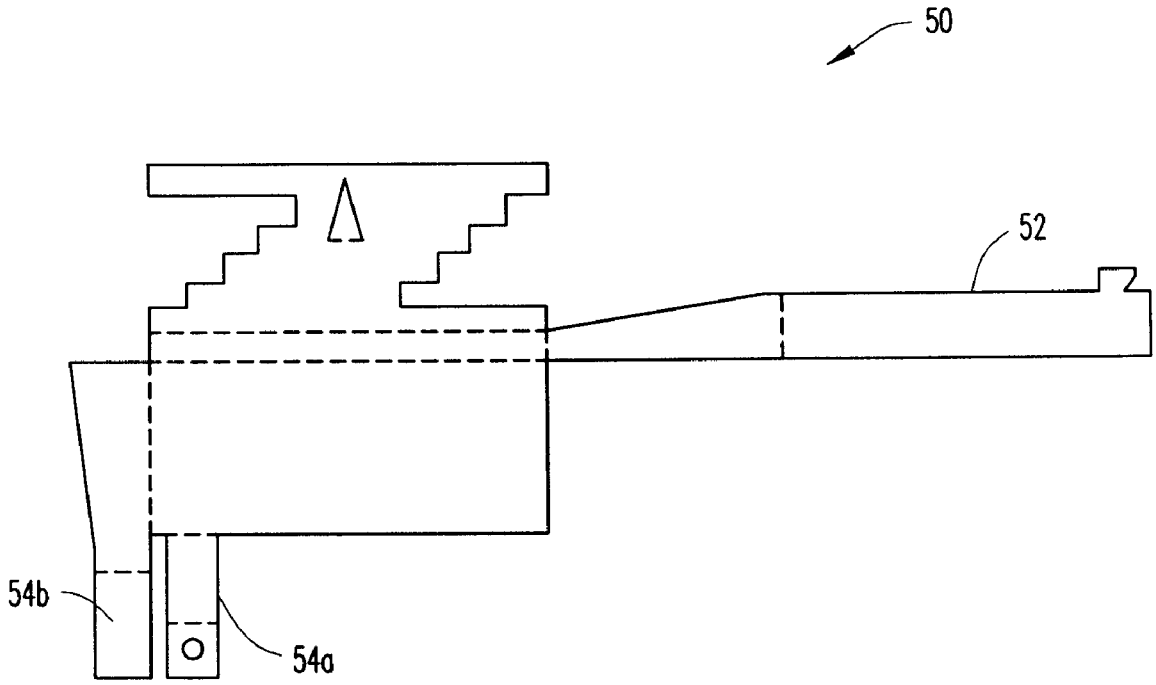
FIGS. 55A–55D schematically illustrate a patch antenna apparatus and a manner of construction thereof according to another embodiment of the present invention.
Figure 55B:
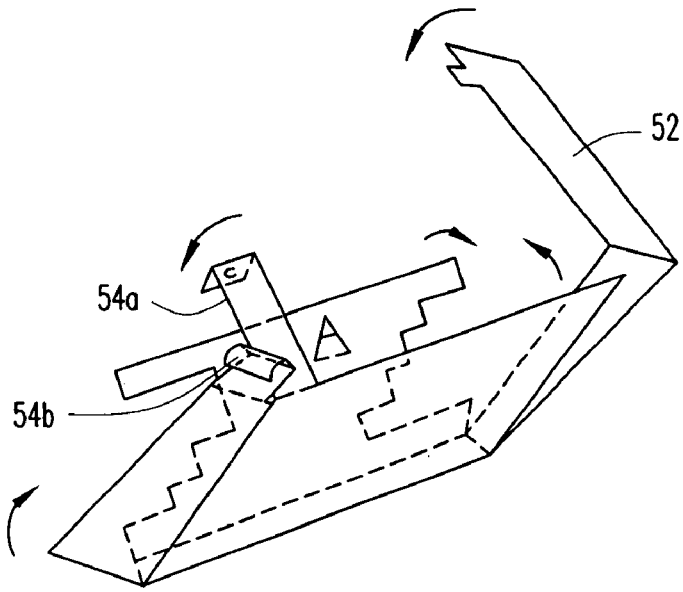
Figure 55C:
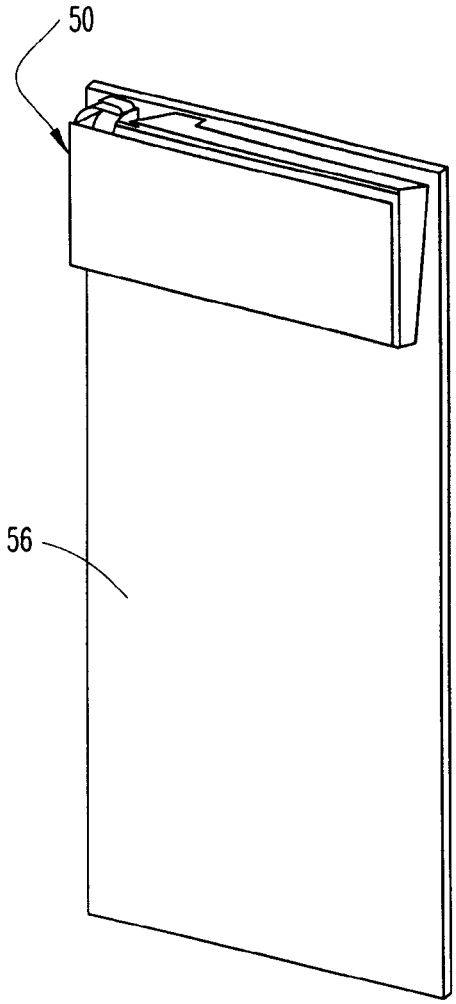
Figure 55D:
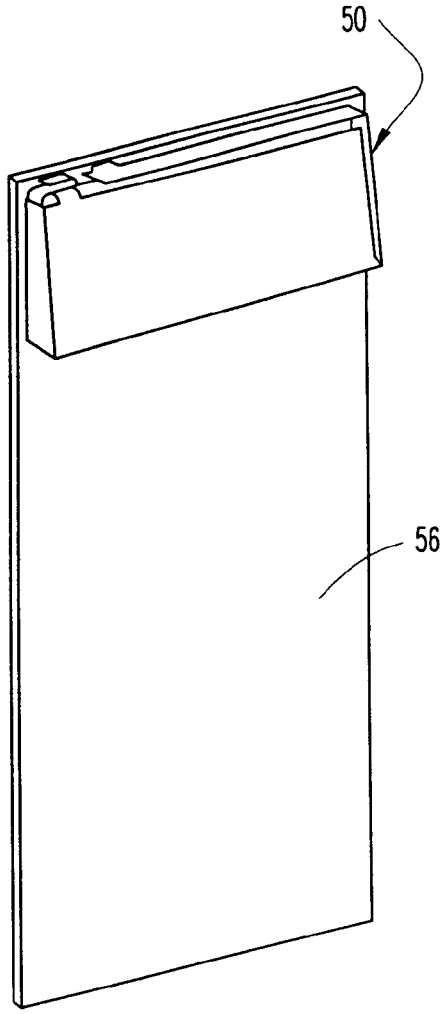

The outer patch portion 34 of the patch antenna can be enlarged at the high frequency matching side and bent downwardly by 90 degrees just outside the straight copper strip until it ends immediately above the ground plane. The patch enlargement constitutes a complement to or when extended with a U-shaped stub, also as a replacement for the short matching copper strip. FIG. 55A illustrates the initial flat punched layout of a patch antenna 50 according to a further embodiment of the invention with the long and short matching strips 52 and 54*b* formed thereon together with a ground connection strip 54*a*, and FIG. 55B illustrates the folding process. FIGS. 55C and 55D are plan views illustrating the completed patch antenna 50 mounted to a ground-plane back-up element 56.

Figure 56:
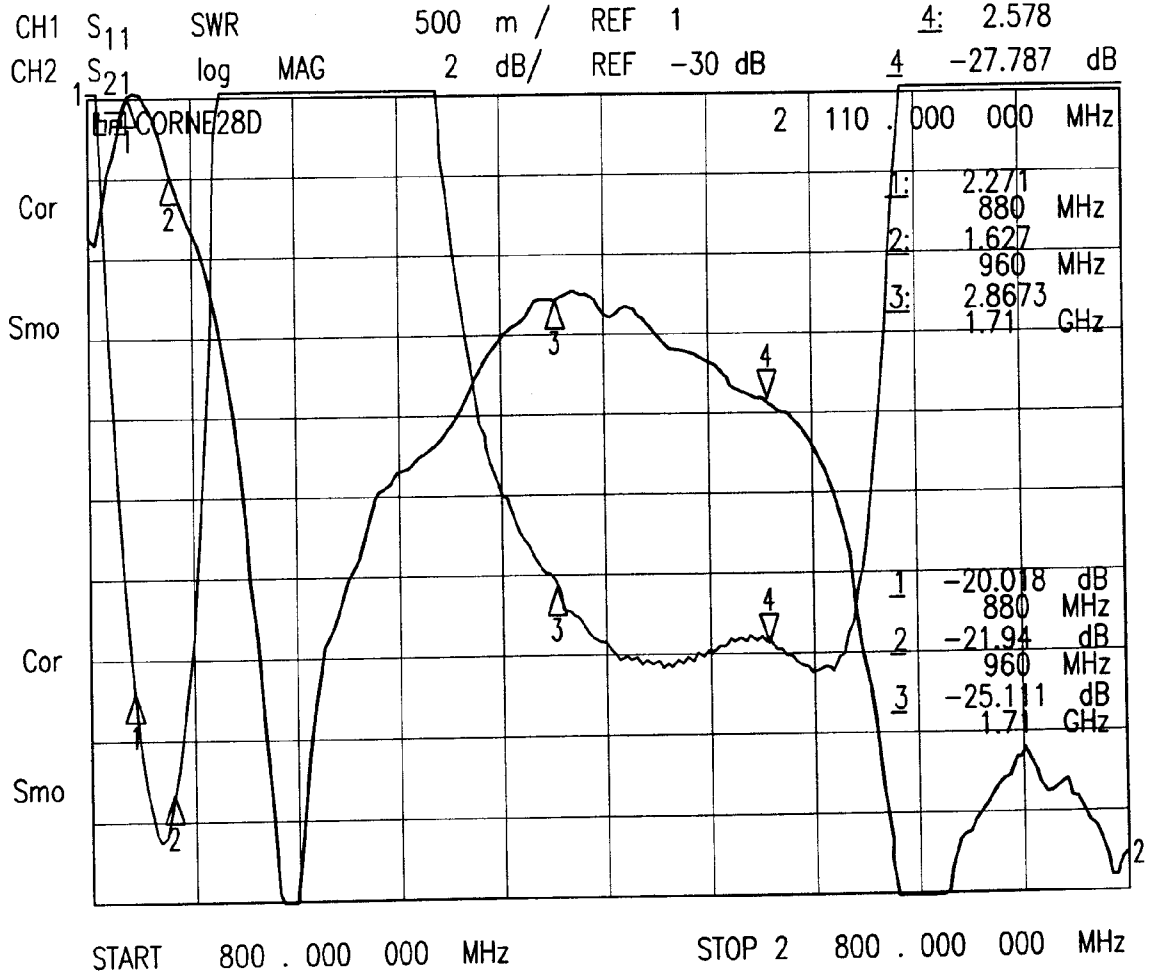
FIGS. 56–58 are diagrams that illustrate examples of a VSWR curve and a transmission curve for a 3-band (GSM, DCS, PCS) which can be switched to a 1-band (GSM) or a 2-band (DCS, PCS) Feedback Patch Antenna apparatus according to a further embodiment of the invention.
Figure 57:
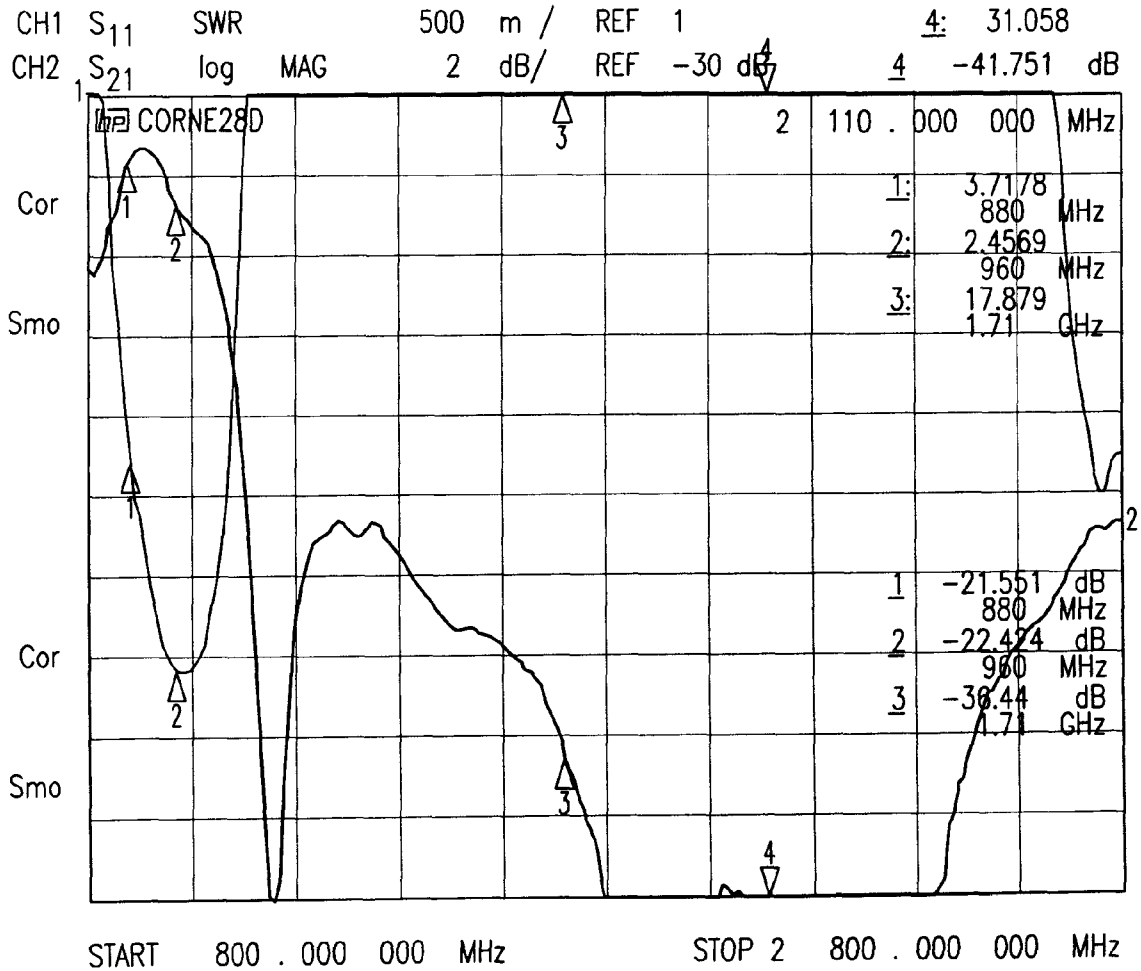
Figure 58:
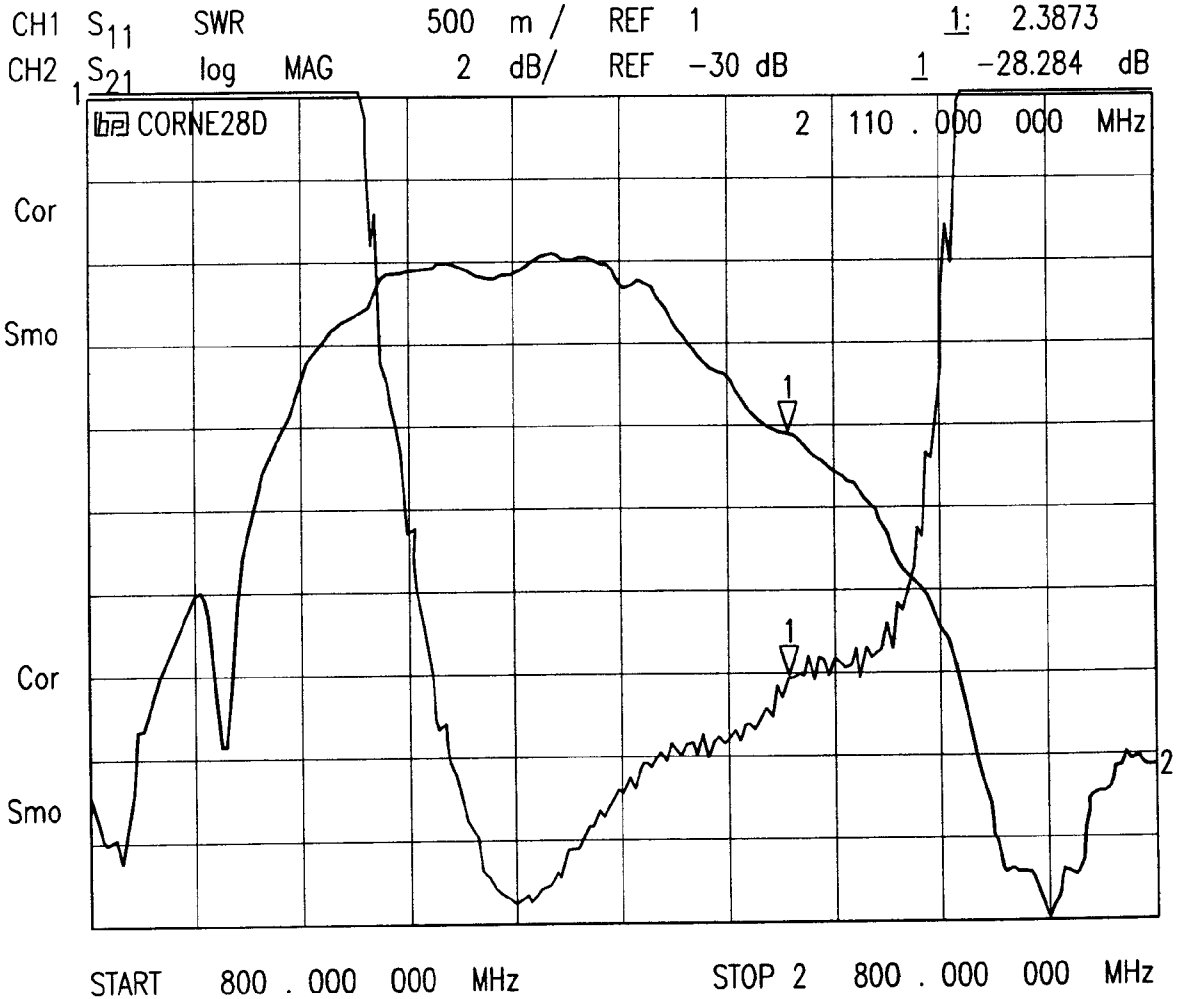

As mentioned previously, the multiband feedback patch antenna apparatus of the present invention can be controlled by the control system of the mobile phone in which it is mounted by a simple impulse that closes the frequency band that is not in use. FIGS. 56, 57 and 58 are diagrams that illustrate some examples of this control. In particular, FIG. 56 illustrates measured curves, $S_{12}$ (transmission-dashed line) and $S_{11}$, (VSWR-solid line) as functions of the frequency for a 3-band (GSM, DCS, PCS) feedback patch antenna apparatus. FIG. 57 shows the changes of the curves $S_{11}$, and $S_{12}$ when a switch in the phone goes from open to short. The upper frequency range 1710–2170 MHz is shut off. FIG. 58 shows the changes of curves $S_{11}$, and $S_{12}$ when a second switch in the phone goes from open to short. The lower frequency band 880–900 MHz is cut off.

The result shown in FIG. 58 where the lower frequency band is cut off requires that the reflector-and-slot extension metal arm that is bent down in front of the third slot be galvanically grounded by means of, for example, a chipswitch at a point in the vicinity of the 90 degree bow of the metal arm. A corresponding measure to obtain the result that is shown in FIG. 57, where the upper frequency band is cut off, is to make a capacitive grounding of the center of the upper edge of the inner patch.

Figure 59:
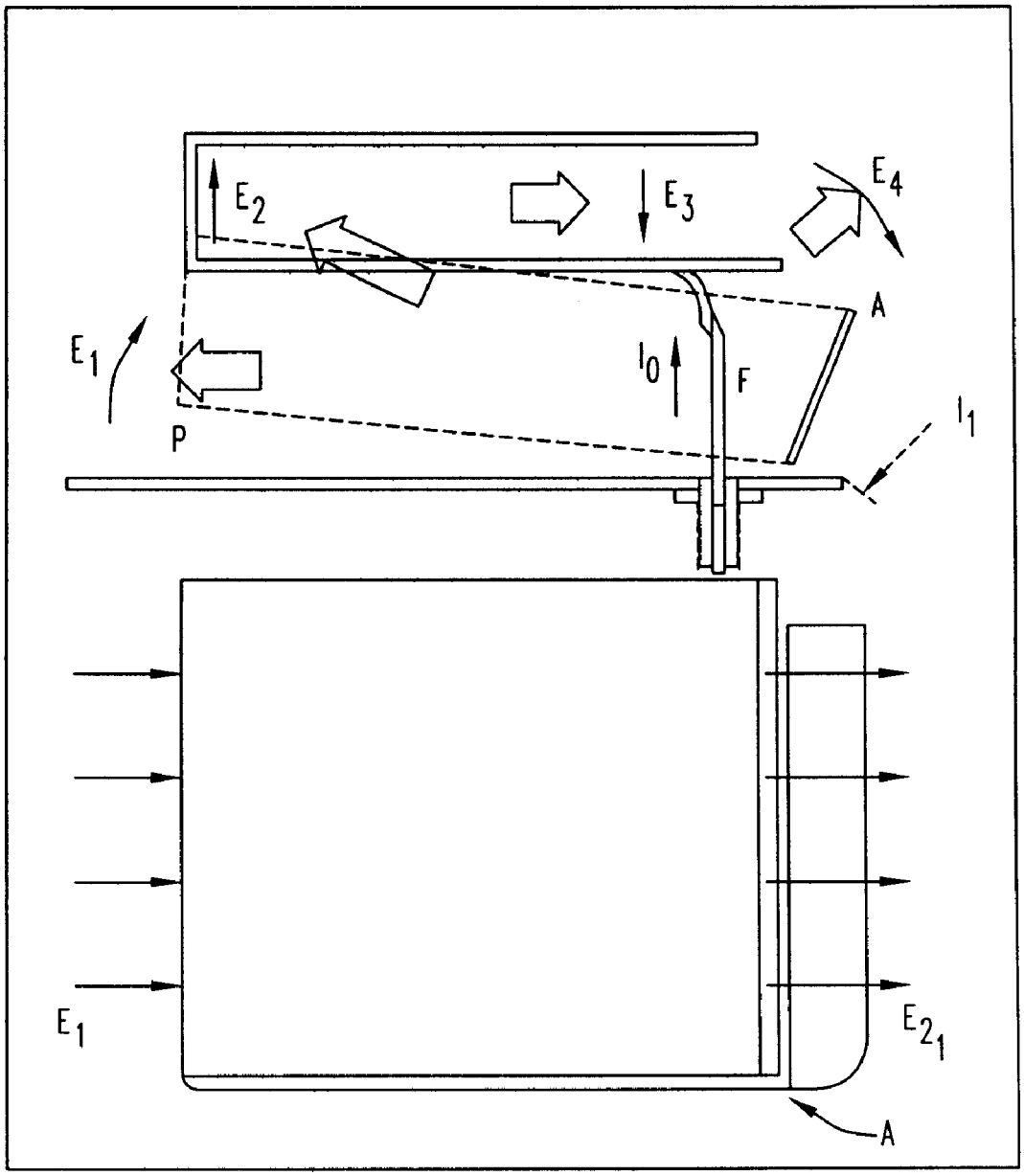
FIG. 59 is a "method of images" diagram to assist in explaining the operation of a patch antenna apparatus including a reflector-and-slot extension arm according to an embodiment of the present invention.

As described previously, the reflector-and-slot extension metal arm 48 that runs up along the right short side of the patch portions at a distance of about 1 mm is bent at 90 degrees above the third slot 44 at the upper corner of the patch portions, to give to the outgoing wave from the third slot a 180 degree phase shift by reflex feedback. FIG. 59 is a "method of images" diagram to assist in explaining the operation of a patch antenna apparatus according to the present invention. The current $I_0$ in the probe feed F shown in FIG. 59 is reflected in the reflector-and-slot-extension metal arm A in front of the third slot 44. This is the slot described previously between the upper edge of the inner hourglass-shaped patch portion and the copper ground plane. The mirror arm A is replaced by an image current $I_1$ which is a reflected image of the current $I_0$ and where $I_1$ has the same amplitude as $I_0$ but is phase shifted by 180 degrees and is located at reflected image distance behind the mirror arm A of FIG. 59.

The bandwidth of the antenna apparatus can be increased somewhat if the V-shaped cut-outs forming the hourglass-shaped inner patch portion is shaped such that the edges in the V's of the inner patch portion is of a staircase design having, for example, four steps. Such a configuration is illustrated in the antenna 60 shown in FIG. 60.

Figure 60:
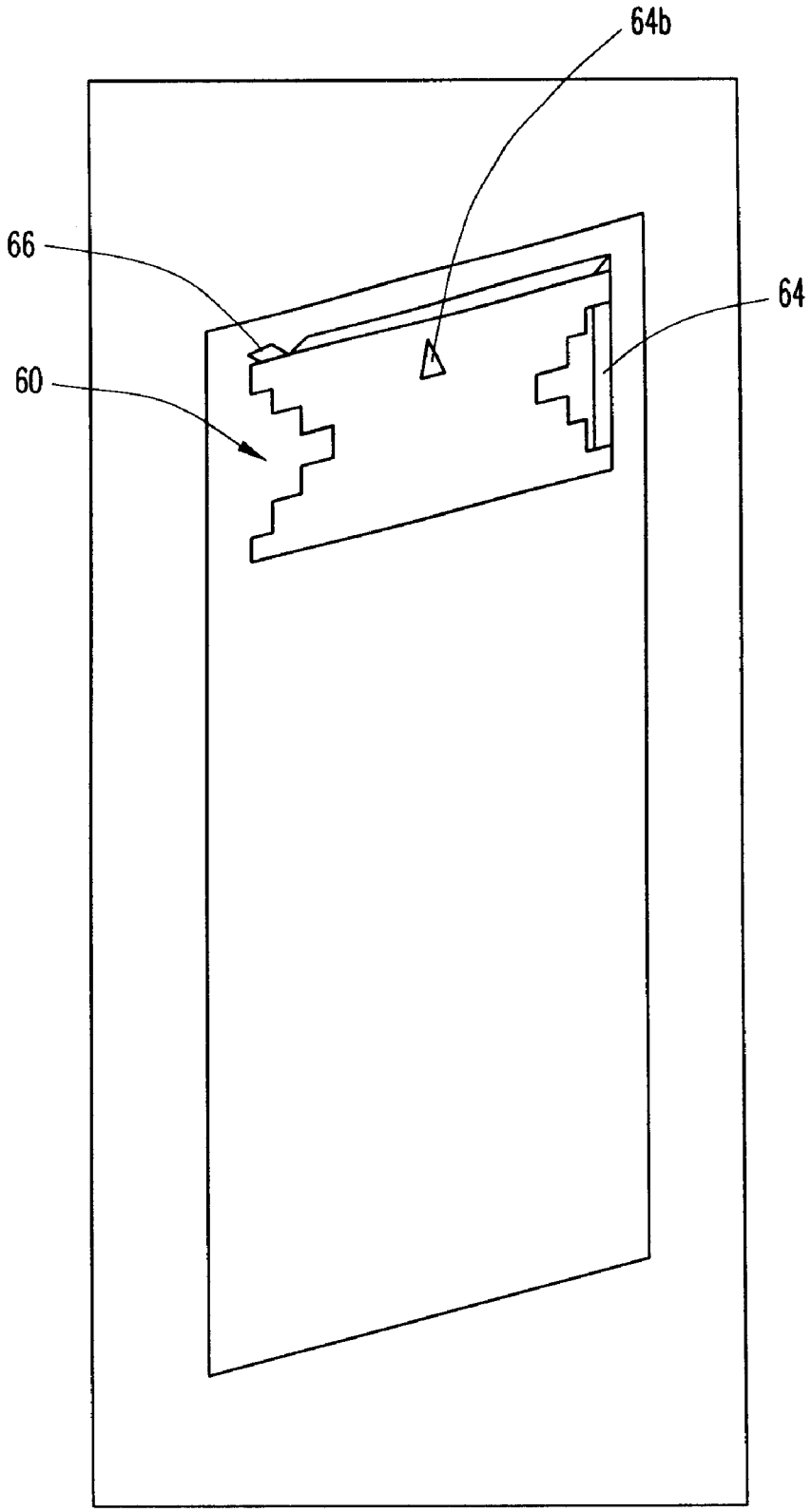
FIG. 60 schematically illustrates a single layer micro patch antenna apparatus according to a further embodiment of the present invention.

FIG. 60 also illustrates a patch antenna apparatus according to a further embodiment of the invention. Specifically, it has also been discovered that a feedback patch antenna can be made solely of a single micro-patch and a reflector-and-slot-extension metal arm. In particular, a single layer micro-patch 60 having a width of 42 mm, a height of 21 mm (24 mm including a metal arm 64) and a thickness of 10 mm along its lower edge and 8 mm along its upper edge has been built and tested. The tests showed that an hourglass shape with some sort of modulation should be used as indicated by the staircase pattern in FIG. 60. The parameters that can be used to reach matching to a 50-ohm system at the present frequency bands are: design of the hourglass modulation, metal arm 64 and its position, the length and position of the copper flap feed probe 64*b* and selection of the best point for antenna ground connection 66.

When compared with the folded micro-patch antenna apparatus such as illustrated in FIGS. 2A and 2B, not very much is gained insofar as the overall dimensions are concerned, however, the manufacturing process may be simplified and the performance data is approximately the same.

Figure 61:
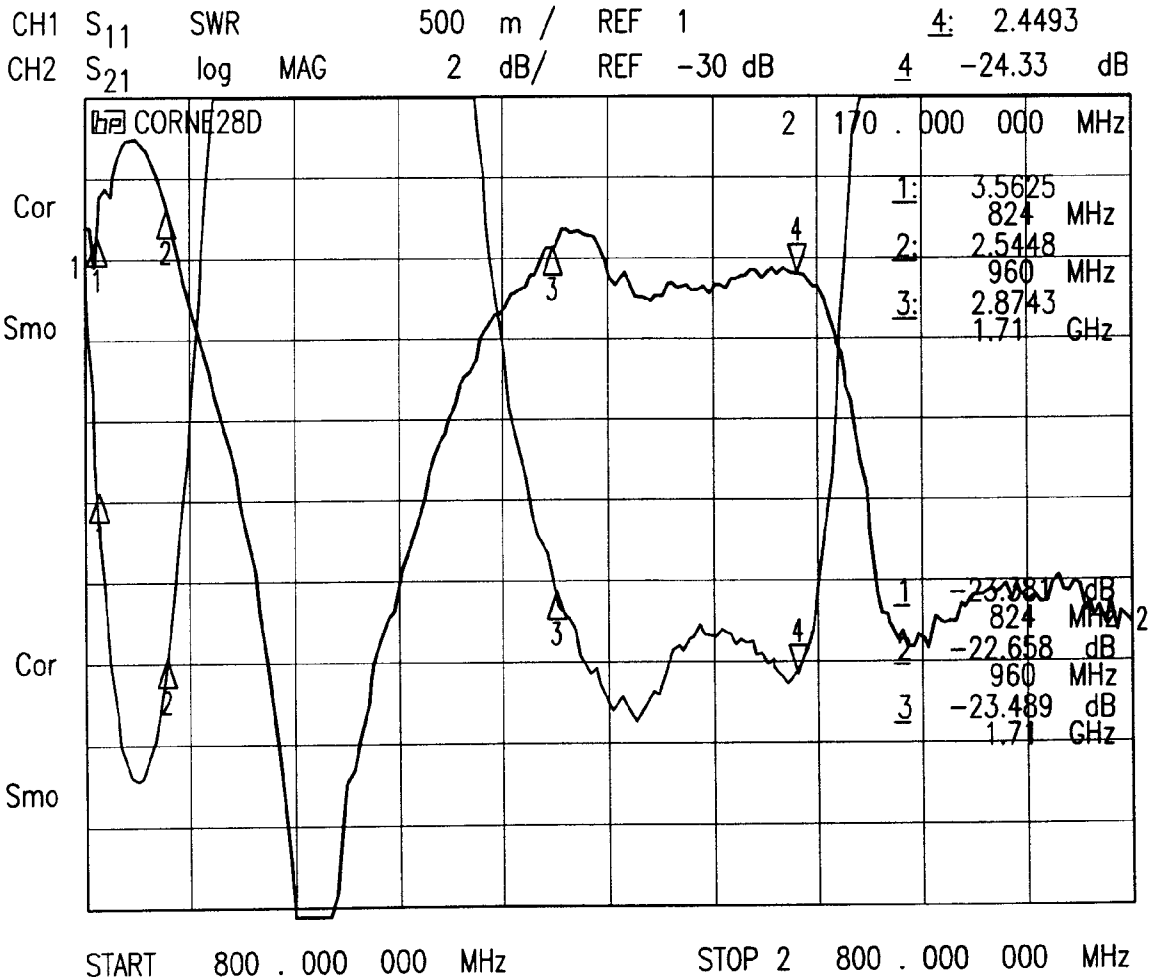
FIGS. 61–65 are diagrams that illustrate measured results of the operation of the single layer micro patch antenna apparatus of FIG. 60.
Figure 62:
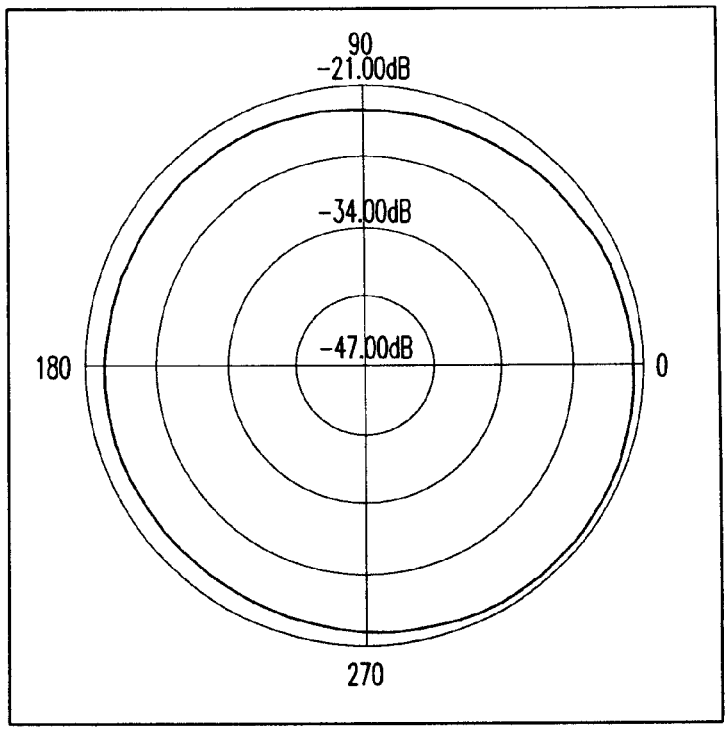
Figure 63:
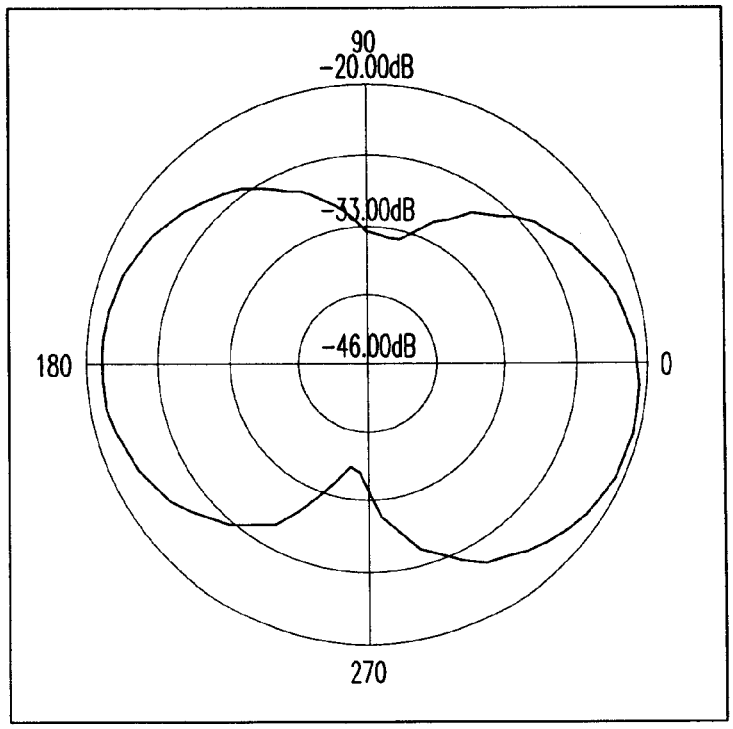
Figure 64:
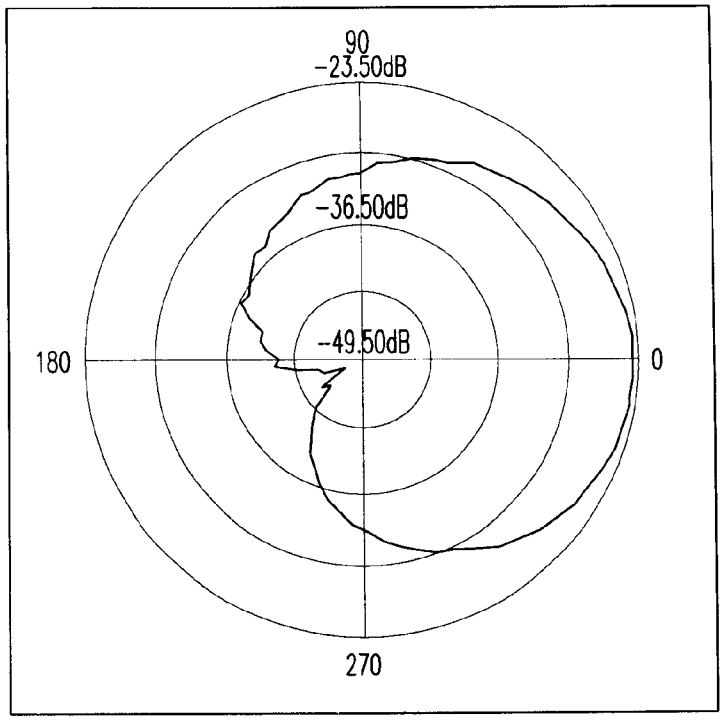
Figure 65:
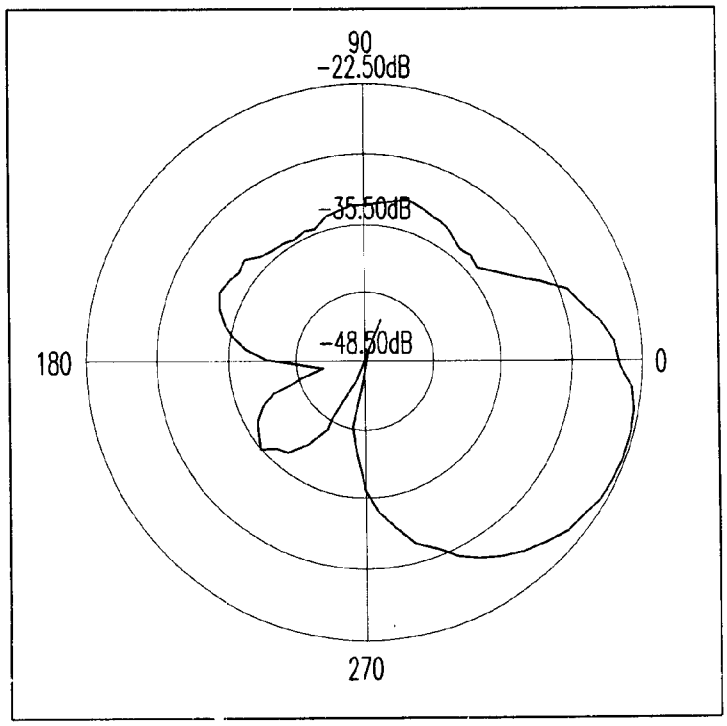

FIGS. 61 is an $S_{11}/S_{12}$ diagram and FIGS. 62–65 are radiation diagrams illustrating some measured results at frequencies 830 MHz and 2170 MHz for the single layer multi-band-patch antenna apparatus illustrated in FIG. 60. The antenna feed probe was made up of a copper flap that was cut out from the surface of the patch and bent 90 degrees to reach the feed point of the mobile phone.

Figure 66A:
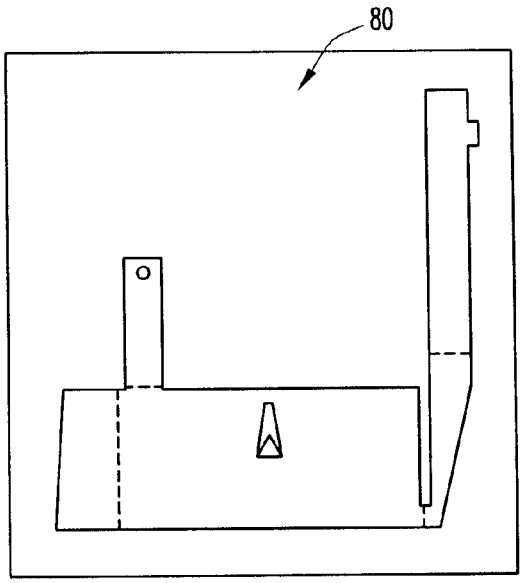
FIGS. 66A–66C schematically illustrate a patch antenna apparatus and a manner of construction thereof according to a further embodiment of the present invention.
Figure 66B:
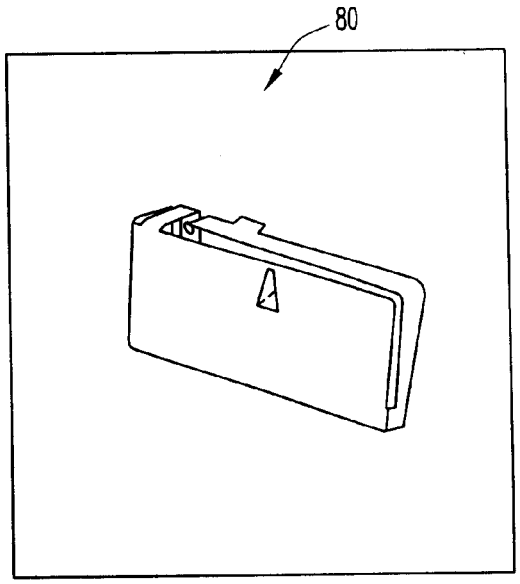
Figure 66C:
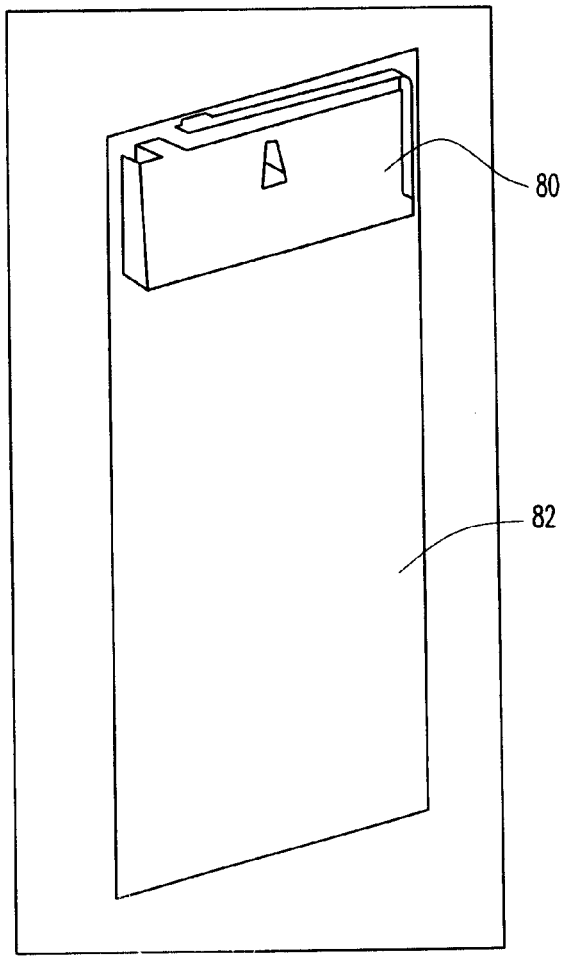

FIGS. 66A, 66B and 66C illustrate a feedback patch antenna apparatus 80 according to another embodiment of the present invention for facilitating manufacture of the patch antenna apparatus. In particular, the main reason for giving the inner patch portion of the apparatus of FIGS. 2A and 2B an hourglass shape was to make it easier to get some part of the energy transferred from the space between the inner patch portion and the copper back plate to the space between the inner and outer patch portions. The same situation does not exist with respect to the feedback single micropatch antenna having only a single patch; and, accordingly, a feedback single micropatch antenna having a rectangular form may be utilized. This antenna apparatus is illustrated in FIGS. 66A, 66B and 66C wherein FIG. 66A illustrates the patch layout before folding, FIG. 66B illustrates the folded patch antenna and FIG. 66C illustrates the patch assembled to a copper back plate 82.

Figure 67:
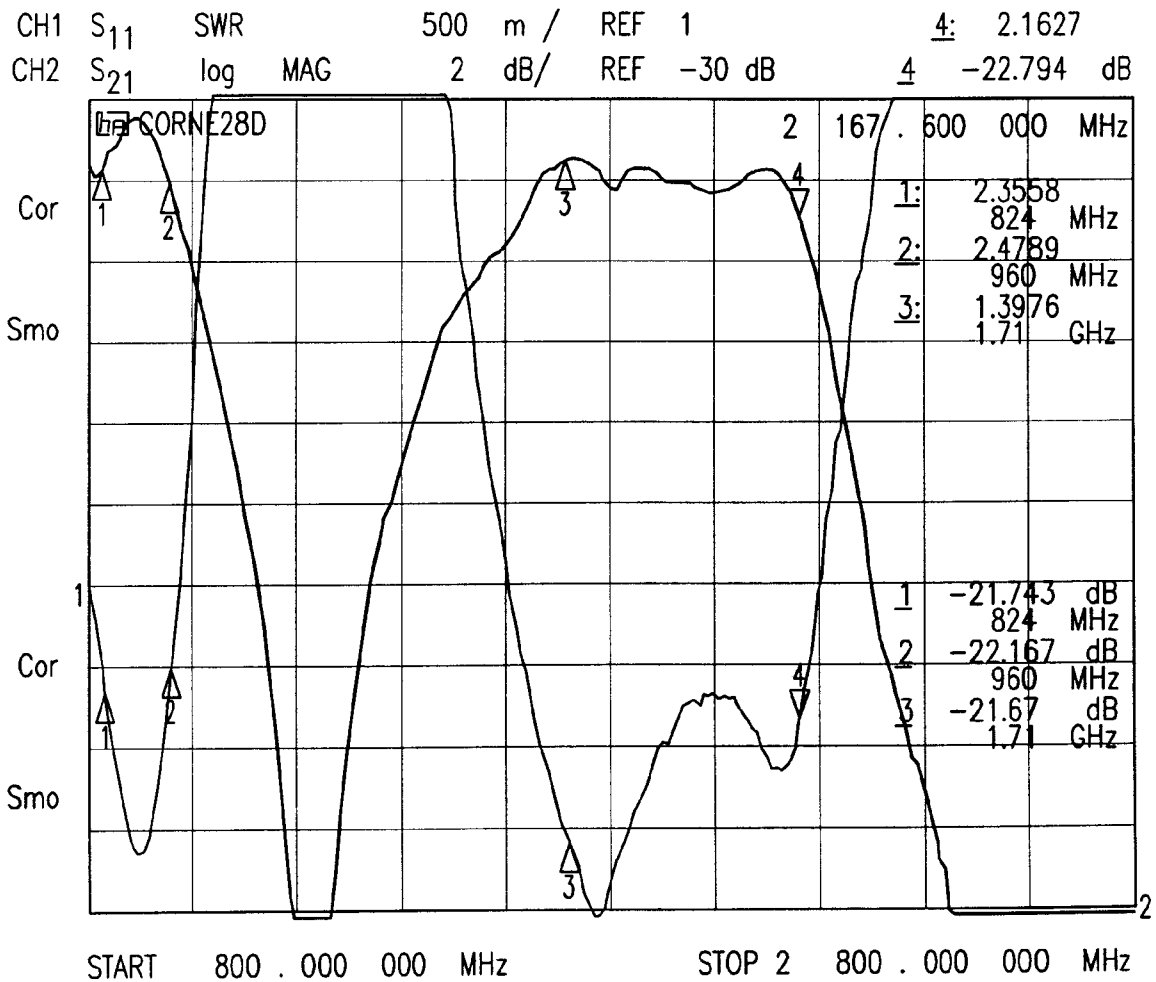
FIG. 67 is a graph that illustrates an example of a VSWR curve and a radiation curve for the patch antenna apparatus of FIGS. 66A–66C.
Figure 68:
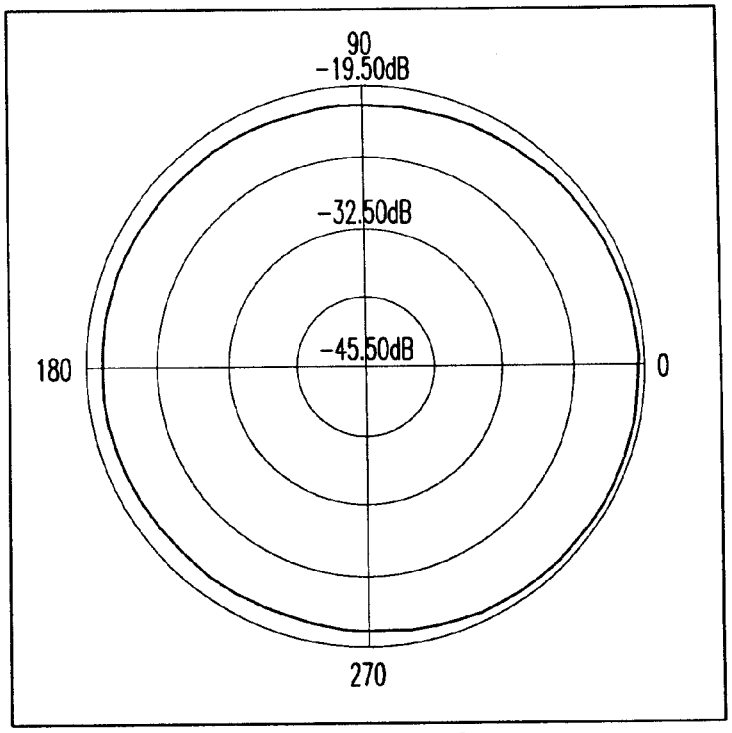
FIGS. 68–75 are measured radiation diagrams for the patch antenna apparatus of FIGS. 66A–66C.
Figure 69:
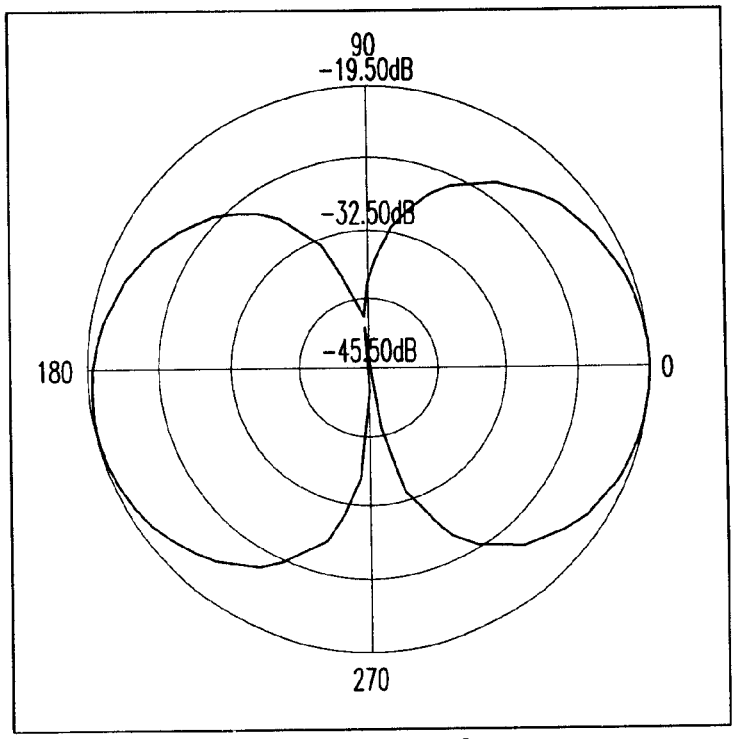
Figure 70:
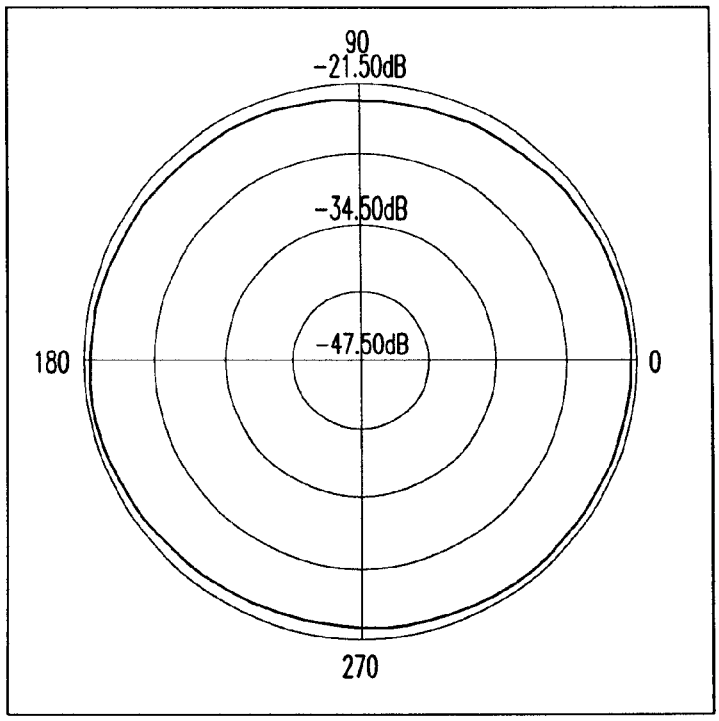
Figure 71:
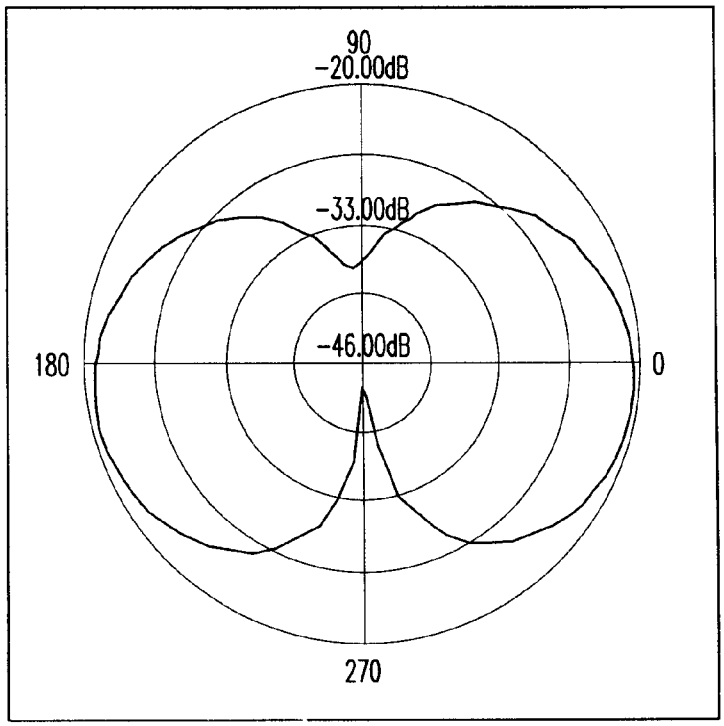
Figure 72:
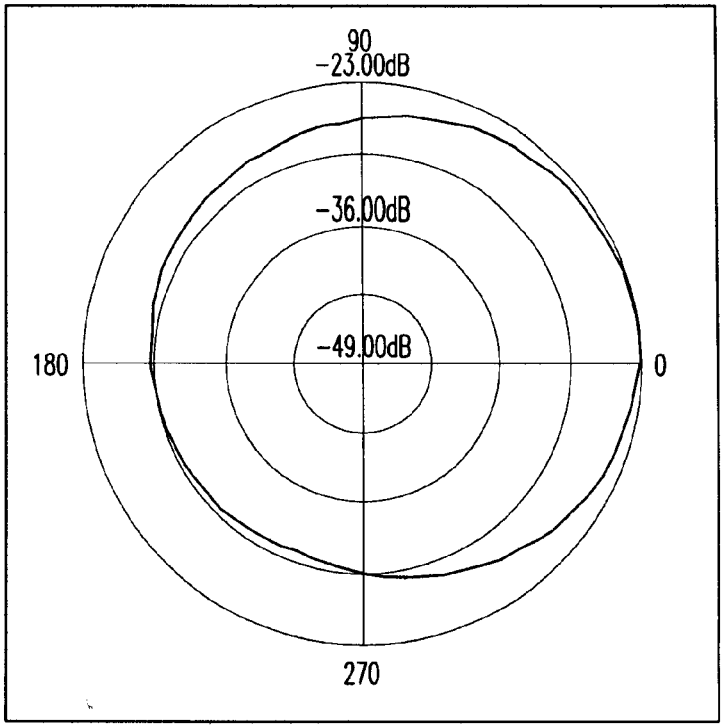
Figure 73:
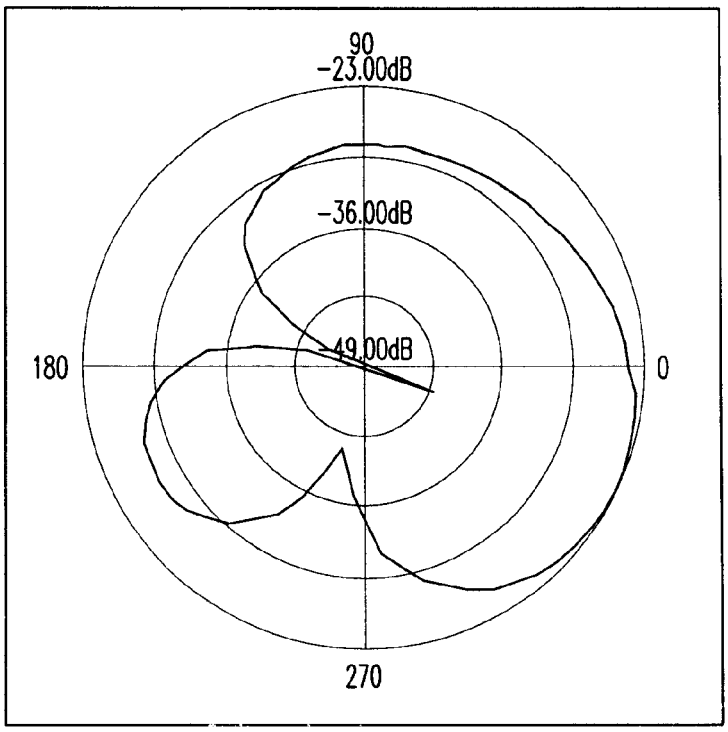
Figure 74:
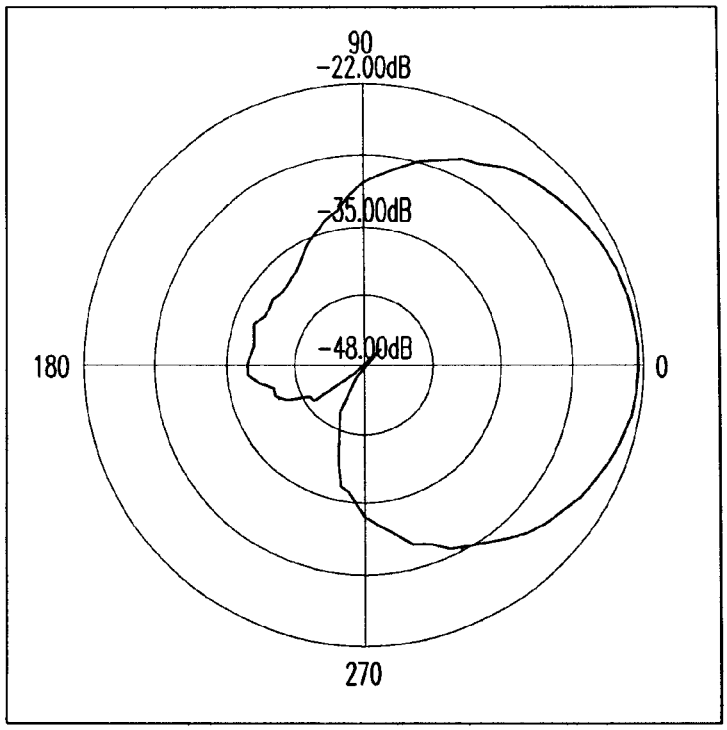
Figure 75:
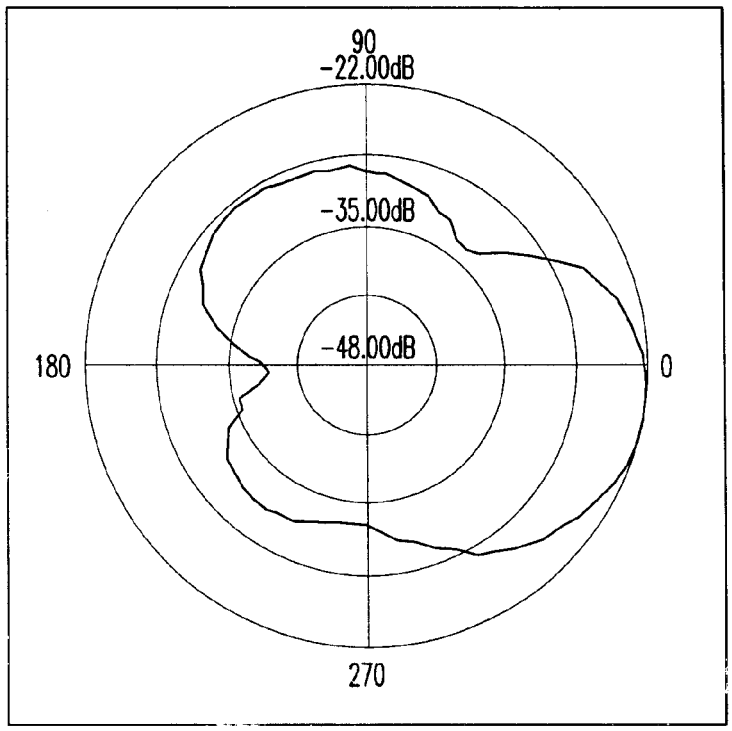

FIG. 67 is a diagram that illustrates $S_{11}$=VSWR (solid curve) and $S_{12}$=transmission in the direction extending perpendicularly out from the back of the mobile phone (dashed curve) measured on a "Feedback Single Rectangular Micropatch Antenna" with a rectangular form as illustrated in FIGS. 66A–C and having dimensions of 41×19×9 mm (about 0.11×0.05×o0.024λ at 824 MHz). The measurements are in conformity with previous measurements made with the patch antenna apparatus of FIGS. 2A and 2B, i. e., an antenna mounted parallel to and 8 mm below the upper short side of the copper back plate, which size is 105×45×0.5 mm, and with a plastic mobile phone cover fitting to the size of the copper back plate and applied on both the front and backside and including a battery pack just below the patch antenna apparatus.

The radiation diagrams of FIGS. 68–75 for the "Feedback Single Rectangular Micropatch Antenna" of FIGS. 66A–C were measured in the same way as the previously described radiation diagrams with the antenna mounted on a copper plate with plastic covers including a battery pack. The radiation plots were measured in the H-plane (FIGS. 68, 70, 72 and 74) and in the E-plane (FIGS. 69, 71, 73 and 75) with 0 degrees equal to the direction perpendicular out of the back of the mobile phone.

In general, it is somewhat simpler to obtain a broad bandwidth in a multiband solution with the "Double Surface Feedback Patch Antenna than with the "Single Surface Feedback Antenna"; however, both give about the same performance results and have about the same size. The "Single Surface Rectangular Feedback Antenna" apparatus, however, will be less expensive to manufacture.

It should be understood that the term "comprises/comprising" when used in this specification, is taken to specify the presence of stated features, integers, steps or components; but does not preclude the presence or addition of one or more other features, integers, steps, components or groups thereof.

While what has been described herein constitutes presently preferred embodiments of the invention, it should be understood that the invention can be varied in numerous ways without departing from the scope thereof. Because the invention can be varied in numerous ways, it should be recognized that the invention should be limited only insofar as is required by the scope of the following claims.

We claim:

1. An antenna apparatus for a portable communications device, said antenna apparatus comprising:

a patch radiator member;

a ground-plane back-up element for said patch radiator member; and a feed arrangement connecting said patch radiator member to radio circuitry in said portable communications device, wherein said patch radiator member includes an inner patch portion and an outer patch portion that are spaced from and substantially parallel to one another and that define a first open slot between first edges of said inner and outer patch portions, and a metallic wall portion connecting second edges of the inner and outer patch portions that are opposed to said first edges, said metallic wall portion extending along substantially an entire length of said second edges of the inner and outer patch portions and reflecting a wave propagating toward said metallic wall portion and feeding the reflected wave toward the first open slot with a 180 degree phase reversal.

2. The antenna apparatus according to claim 1, wherein said inner patch portion comprises an hourglass-shaped patch portion and is adjacent and substantially parallel to said ground-plane back-up element.

3. The antenna apparatus according to claim 2, wherein V-shaped edges of said hourglass-shaped patch portion have a staircase configuration.

4. The antenna apparatus according to claim 3, wherein said staircase configuration includes four steps.

5. The antenna apparatus according to claim 1, and further including a second open slot between said second edge of said inner patch portion and said ground plane back-up element.

6. The antenna apparatus according to claim 5, wherein said patch radiator member further includes a reflector-and-slot-extension metallic arm that extends from an end of said metallic wall portion parallel to side edges of the patch portions and in a plane perpendicular to a plane of the inner and outer patch portions, said reflector-and-slot extension-metallic arm folded over a third open slot between the first edge of the inner patch portion and said ground plane back-up element to provide a 180 degree phase reversal by reflect-feedback of an outgoing wave from the third slot.

7. The antenna apparatus according to claim 2, wherein said outer patch portion is of generally rectangular shape and is grounded at a corner thereof by a grounding member.

8. The antenna apparatus according to claim 7, wherein said grounding member comprises a metallic strip galvanically connected to a back side of said ground-plane back-up element.

9. The antenna apparatus according to claim 1, and further including first and second impedance matching strips positioned in planes perpendicular to surfaces of said inner and outer patch portions for impedance matching of said antenna apparatus.

10. The antenna apparatus according to claim 9, wherein said first and second impedance matching strips are of different lengths for impedance matching of said antenna apparatus to different frequency bands.

11. The antenna apparatus according to claim 2, wherein said outer patch portion is enlarged at one side thereof, said enlargement bent downwardly by 90 degrees and ending immediately above said ground-plane back-up element.

12. The antenna apparatus according to claim 1, wherein said patch radiator member comprises a miniaturized patch radiator member having a size $0.11\lambda \times 0.05\lambda$.

13. The antenna apparatus according to claim 1, wherein said portable communications device comprises a mobile phone.

14. The antenna apparatus according to claim 1, wherein said antenna apparatus is configured to operate as a broadband antenna.

15. The antenna apparatus according to claim 1, wherein said antenna apparatus is configured to operate as a multiband antenna.

16. The antenna apparatus according to claim 15, and further including switch means in said portable communications device for closing frequency bands of said multiband antenna that are not in use.

17. The antenna apparatus according to claim 1, wherein said antenna apparatus operates in at least one frequency band.

18. The antenna apparatus according to claim 17, wherein said at least one frequency band includes one or more of 900 MHz, 1800 MHz and 1900 MHz frequency bands.

19. An antenna apparatus for a portable communications device, said antenna apparatus comprising:

a patch radiator member;

a ground-plane back-up element for said patch radiator member, said patch radiator member being spaced from said ground-plane back-up element to define a first open slot between a first edge of said patch radiator member and said ground-plane back-up element;

a feed arrangement connecting said patch radiator member to radio circuitry in said portable communications device; and a reflector-and-slot-extension arm that is attached to a portion of one side of said patch radiator member, extends along said one side of said patch radiator member and is folded over said first open slot to provide a 180 degree phase reversal by reflect-feedback of an outgoing wave from said first slot.

20. The antenna apparatus according to claim 19, wherein said patch radiator member comprises an hourglass-shaped patch radiator member.

21. The antenna apparatus according to claim 20, wherein V-shaped edges of said hourglass-shaped patch portion have a staircase configuration.

22. The antenna apparatus according to claim 19, wherein said patch radiator member comprises a rectangular-shaped patch radiator member.

23. The antenna apparatus according to claim 19, wherein said patch radiator member is grounded by a grounding member.

24. The antenna apparatus according to claim 19, wherein said reflector-and-slot-extension arm is substantially perpendicular to said patch radiator member.

25. The antenna apparatus according to claim 19, wherein said patch radiator member is enlarged at one side thereof, said enlargement bent downwardly by 90 degrees and ending immediately above said ground-plane back-up element.

26. The antenna apparatus according to claim 19, wherein said patch radiator member includes an inner patch portion and an outer patch portion, and wherein said first open slot is between a first edge of said inner patch portion and said ground-plane back-up element, and wherein said antenna apparatus further includes a second open slot between said first edge of said inner patch portion and a first edge of said outer patch portion, and a metallic wall portion connecting second edges of said inner and outer patch portions that are opposed to said first edges, said metallic wall portion reflecting a wave propagating toward said metallic wall and feeding the reflected wave toward said second open slot with a 180 degree phase reversal.

27. The antenna apparatus according to claim 19, wherein said patch radiator member comprises a miniaturized patch radiator member having a size $0.11\lambda \times 0.05\lambda$.

28. The antenna apparatus according to claim 19, wherein said portable communications device comprises a mobile phone.

29. The antenna apparatus according to claim 19, wherein said antenna apparatus operates at one or more of 900 MHz, 1800 MHz and 1900 MHz frequency bands.

30. An antenna apparatus for a portable communications device, said antenna apparatus comprising:

a patch radiator member;

a ground-plane back-up element for said patch radiator member;

a feed arrangement connecting said patch radiator member to radio circuitry in said portable communications device, wherein said patch radiator member includes an inner patch portion and an outer patch portion that are spaced from and substantially parallel to one another and that define a first open slot between first edges of said inner and outer patch portions, and a metallic wall portion connecting second edges of the inner and outer patch portions that are opposed to said first edges, said metallic wall portion reflecting a wave propagating toward said metallic wall portion and feeding the reflected wave toward the first open slot with a 180 degree phase reversal; and a reflector-and-slot extension metallic arm that extends from an end of said metallic wall portion parallel to side edges of the inner and outer patch portions and in a plane perpendicular to a plane of the inner and outer patch portions, said reflector-and-slot extension metallic arm folded over a second open slot between the first edge of the inner patch portion and said ground plane back-up element to provide a 180 degree phase reversal by reflect-feedback of an outgoing wave from the second slot.

* * * * *